US008853624B2

(12) United States Patent
Whitehouse et al.

(10) Patent No.: US 8,853,624 B2
(45) **Date of Patent: *Oct. 7, 2014**

(54) SINGLE AND MULTIPLE OPERATING MODE ION SOURCES WITH ATMOSPHERIC PRESSURE CHEMICAL IONIZATION

(71) Applicant: PerkinElmer Health Sciences, Inc., Waltham, MA (US)

(72) Inventors: Craig M. Whitehouse, Branford, CT (US); Victor Laiko, Branford, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/959,243

(22) Filed: Aug. 5, 2013

(65) Prior Publication Data

US 2013/0341503 A1 Dec. 26, 2013

Related U.S. Application Data

(63) Continuation of application No. 13/183,693, filed on Jul. 15, 2011, now Pat. No. 8,502,140, which is a continuation of application No. 12/474,379, filed on May 29, 2009, now Pat. No. 7,982,185.

(60) Provisional application No. 61/057,273, filed on May 30, 2008.

(51) Int. Cl.

| | |
|---|---|
| ***H01J 49/26*** | (2006.01) |
| ***H01J 49/14*** | (2006.01) |
| ***H01J 49/04*** | (2006.01) |
| ***H01J 49/16*** | (2006.01) |

(52) U.S. Cl.

CPC ..... *H01J 49/145* (2013.01); *H01J 49/045* (2013.01); *H01J 49/168* (2013.01)

USPC ..... 250/288; 250/287; 250/282

(58) Field of Classification Search

CPC ..... H01J 49/26

USPC ..... 250/288

See application file for complete search history.

(56) References Cited

U.S. PATENT DOCUMENTS 4,542,293 A 9/1985 Fenn et al.
4,546,253 A 10/1985 Tsuchiya et al.

(Continued)

FOREIGN PATENT DOCUMENTS

| | | |
|---|---|---|
| JP | H08-236064 | 9/1996 |
| JP | 2005-353340 | 12/2005 |
| JP | 2007-010667 | 1/2007 |

OTHER PUBLICATIONS

Yamaguchi, K., "Recent Progress in Organic Analysis Using Liquid Chromatograph Mass Spectrometer (LC-MS)—Recent Progress of Analytical Technologies in Hygiene Chemistry VII," Hygiene Chemistry, 42(5):367-384 (1996) (Translated Abstract).

(Continued)

*Primary Examiner* — Phillip A Johnston

(74) *Attorney, Agent, or Firm* — Fish & Richardson P.C.

(57) ABSTRACT

An Atmospheric Pressure Chemical Ionization (APCI) source interfaced to a mass spectrometer is configured with a corona discharge needle positioned inside an APCI inlet probe assembly. Liquid sample flowing into the APCI inlet probe is nebulized and vaporized prior to passing through the corona discharge region all contained in the APCI inlet probe assembly. The APCI probe is configured to shield the electric field from the corona discharge region while allowing penetration of an external electric field to focus APCI generated ions into an orifice into vacuum for mass to charge analysis. Ions that exit the APCI probe are directed only by external electric fields and gas flow maximizing ion transmission into a mass to charge analyzer. Sample ions and gas phase reagent ions are generated in the APCI probe from liquid or gas inlet species or mixtures of both.

13 Claims, 26 Drawing Sheets

(56) References Cited

U.S. PATENT DOCUMENTS

| | | | | |
|---|---|---|---|---|
| 6,949,741 | B2 | 9/2005 | Cody et al. | |
| 7,041,972 | B2 | 5/2006 | Bajic et al. | |
| 7,078,681 | B2 | 7/2006 | Fischer et al. | |
| 7,223,968 | B2 | 5/2007 | Fischer et al. | |
| 7,569,812 | B1 * | 8/2009 | Karpetsky et al. | 250/282 |
| 7,982,185 | B2 * | 7/2011 | Whitehouse et al. | 250/288 |
| 8,502,140 | B2 * | 8/2013 | Whitehouse et al. | 250/288 |
| 2006/0255261 | A1 | 11/2006 | Whitehouse et al. | |
| 2007/0023677 | A1 * | 2/2007 | Perkins et al. | 250/425 |
| 2007/0114439 | A1 | 5/2007 | Bajic et al. | |
| 2008/0054177 | A9 | 3/2008 | Andrien et al. | |

OTHER PUBLICATIONS

Translation of Office Action issued in JP2011-511837 on Dec. 3, 2013 (4 pages).

* cited by examiner

SINGLE AND MULTIPLE OPERATING MODE ION SOURCES WITH ATMOSPHERIC PRESSURE CHEMICAL IONIZATION

RELATED APPLICATIONS

This application is a continuation of U.S. Ser. No. 13/183,693, filed Jul. 15, 2011, now U.S. Pat. No. 8,502,140, which is a continuation of U.S. Ser. No. 12/474,379, filed May 29, 2009, now U.S. Pat. No. 7,982,185, which claims priority from U.S. Provisional Patent Application Ser. No. 61/057,273, filed on May 30, 2008.

FIELD OF INVENTION

The invention relates to single and multiple operating mode ion sources utilizing Atmospheric Pressure Chemical Ionization to produce ions at atmospheric pressure for subsequent Mass Spectrometric analysis of chemical, biological, medical, forensic and environmental samples.

BACKGROUND OF THE INVENTION

In Atmospheric Pressure Chemical Ionization (APCI) a charged species is attached or removed from an analyte molecule at atmospheric pressure. Reagent ions are typically produced from a cascade of gas phase reactions initiated in a corona discharge or a glow discharge region at atmospheric pressure. If the gas phase reactions are energetically favorable, the reagent ion will transfer a charged species to an analyte molecule or remove a charged species from an analyte molecule forming an analyte ion. If water present as a reagent gas, hydronium or protonated water $(H_3O)^+$ reagent ions are formed through ionization processes occurring in the corona discharge region in positive ion polarity operation. When a hydronium ion collides with an analyte ion, the proton from the hydronium ion is transferred to the analyte molecule, where the analyte ion has a higher proton affinity than $H_3O^+$, forming a positive polarity $(M+H)^+$ analyte ion and $H_2O$. Conversely, when an $OH^-$ ion, formed through the ionization processes occurring in a negative polarity corona discharge, collides with an analyte molecule having a lower proton affinity than $OH^-$, the analyte molecule transfers a proton to $OH^-$ forming a negative polarity $(M-H)^-$ analyte ion and $H_2O$. Alternative cation species can be formed in the corona discharge region including but not limited to Sodium $(Na^+)$, Potassium $(K^+)$ or Ammonia $(NH_4^+)$. Positive polarity analyte ions can be formed from analyte molecules with low proton affinity through charge exchange with alternative cations. Conversely, negative polarity analyte ions can be formed by attachment of anions such as chlorine $(Cl^-)$ transferred from reagent ions. For some analyte species radical analyte ions are formed in APCI by the addition or removal of an electron.

Sample solutions, such effluent from a Liquid Chromatography (LC) column, are typically pneumatically nebulized and vaporized prior to passing through a corona discharge region where APCI occurs Nitrogen is typically used for pneumatic nebulization of sample solutions and to sustain a corona discharge. Nebulized sample solution droplets are vaporized by passing through a heater operating at a temperature typically between 200 and 450° C. The resulting gas phase mixture of nebulization gas, solvent and analyte vapor sample vapor passes through a corona discharge which is generated by applying a high voltage, usually between 2 to 8 kilovolts, to a sharpened needle or pin. Alternatively, helium may be used to sustain a glow discharge in APCI liquid phase samples. In conventional APCI sources interfaced to mass spectrometers or ion mobility analyzers, the corona needle is located in the atmospheric pressure ion source volume external to the nebulizer and vaporizer sample inlet assembly and close to the sampling orifice of the mass spectrometer (MS) or ion mobility spectrometer (IMS). To achieve the highest APCI/MS or APCI/IMS sensitivity, both the chemical ionization process and the subsequent transport of ions into the sampling orifice of the mass spectrometer or IMS need to be optimized. To maximize Atmospheric Pressure Chemical Ionization efficiency with MS or IMS analysis:

1. The flow of vaporized analyte needs to be concentrated to pass through or neat the corona discharge or glow discharge where the maximum concentration of the reagent ions is located.
2. The corona needle voltage and consequently the corona current requires optimization to produce the highest concentration of the desired reagent ion species.
3. The electric field formed in the region between the corona discharge region and the mass spectrometer or IMS sampling orifice should be optimized to maximize the efficiency ion focusing into the sampling orifice with subsequent transport into vacuum or IMS.

In a conventional APCI/MS source, the corona discharge needle is positioned in the open APCI source chamber close to the sampling orifice. Such conventional ion source configurations are unable to fulfill the above criteria simultaneously. The flow of the analyte vapor quickly expands after exiting the vaporizer, in a conventional APCI source geometry, decreasing the analyte concentration around the corona needle. In addition, the high electric field formed at the tip of the corona needle hinders the formation of optimal focusing electric fields near the sampling orifice needed to focus the analyte ions formed into the orifice into vacuum. The configuration and operation of a conventional APCI source requires a tradeoff between two contradictory processes resulting in less efficient APCI/MS performance.

One embodiment of the present invention provides an improved APCI source design that is optimized for maximum ionization efficiency and improved ion transport efficiency into vacuum. In the preferred embodiment of the invention, the corona discharge needle is positioned in an enclosed vapor flow channel configured at the exit end of the APCI probe vaporizer. The vapor flow channel geometry constrains the analyte vapor to pass through the corona discharge region and the resulting analyte ions are focused toward the vapor flow channel centerline as they pass through the vapor flow and corona discharge channel exit opening. The focusing of the analyte ions toward the centerline minimizes or prevents ion neutralization due to contact with the vapor flow channel wall. The vapor channel partially encloses the high electric fields formed around the corona discharge needle tip shielding the APCI chamber and exiting analyte ions from defocusing electric fields. Voltages applied to electrodes located in the APCI source chamber form focusing electric fields that penetrate into the exit opening of the vapor flow channel. Exiting ions are focused toward the vapor flow channel centerline by these penetrating electric fields improving analyte ion transfer from the APCI probe into the APCI chamber. Electric fields in the APCI chamber continue to direct and focus ions into the sampling orifice into vacuum where they are mass to charge analyzed. The vapor flow channel configuration provides unobstructed flow of gas and ions through the flow channel with minimum loss of analyte ions due to collisions with the channel wall prior to exiting.

U.S. Pat. No. 7,041,972 B2 describes an APCI source comprising a corona discharge needle operated in an enclosure positioned at the exit end of a vaporizer. Ions and neutral vapor exit through a channel opening positioned at ninety degrees to the vaporizer axis and the exit channel is configured with a ninety degree bend before exiting the enclosure. Such a configuration (FIG. 6) creates a region of turbulent flow around the corona discharge needle tip which can increase analyte ion impingement and neutralization on the enclosure walls. The device described provides no direct unobstructed exit flow path and no electrodes configured to focus analyte ions away from surfaces where ion losses can occur. The APCI source configuration described in U.S. Pat. No. 7,041,972 B2 does not provide optimal transport of analyte ions to the sampling orifice into vacuum The present invention incorporates a vapor flow channel surrounding the corona discharge needle tip configured to simultaneously constrain sample vapor flow through the corona discharge to maximize chemical ionization efficiency while minimizing analyte ion losses to the flow channel walls. The vapor flow channel is also configured to partially shield the corona discharge electric field while allowing external ion focusing electric field penetration to maximize ion transfer efficiency to the sampling orifice into vacuum.

It is known that Atmospheric Pressure Chemical Ionization provides efficient ionization for a limited range of chemical species. Typically APCI is used to generate ions for mass spectrometric analysis from lower molecular weight chemical species that can be vaporized without degradation. Electrospray ionization is used to analyze a larger range of compound types including smaller volatile species and thermally labile, polar higher molecular weight chemical species. Although Electrospray ionization considerably overlaps with APCI ionization capability, some analytical applications benefit from the ability to run both Electrospray and APCI ionization to obtain improved ionization efficiency over a broader range of compounds and chemical systems. Multiple embodiments of a combination Electrospray (ES) and APCI source is described in U.S. Pat. No. 7,078,681 B2 wherein sample is introduced through a pneumatic nebulizer that can be operated to produce Electrospray ions. A corona discharge needle is configured in the open source volume to ionize a portion of the evaporated nebulized droplet vapor prior to sampling the ions into vacuum for mass spectrometric analysis. In all embodiments of the combination ion source described in U.S. Pat. No. 7,078,681 B2 all gas and liquid flow enters the ion source from the sample introduction inlet probe and the sample vapor passes through an unshielded corona discharge region. A different combination ES and APCI source configuration is described in patent Number US 207/0114439 A1 wherein sample vapor is generated by pneumatic nebulization of the sample solution with or without Electrospray ionization which subsequently passes through a vaporizer heater. The sample vapor does not pass through a corona discharge but mixes with ions produced from a corona discharge in an enclosed reaction chamber. Electrospray and APCI ions exit the reaction chamber through a 90 degree exit channel into the ion source chamber. Ions exit the reaction chamber driven by gas flow with no electric focusing fields present in the flow path. An alternative embodiment of the present invention is the configuration of an APCI probe with partially shielded corona discharge region and an Electrospray sample inlet probe that combines Electrospray ionization and APCI. This combination ES and APCI source interfaced to a mass spectrometer (MS) performs with high ionization efficiency and high ion transfer efficiency in all operating modes Solid and liquid samples introduced on probes and gas samples introduced directly into an atmospheric pressure ion source can be ionized using APCI where reagent ions are generated from source independent from the introduced sample. One configuration of such an ion source is described in U.S. Pat. No. 6,949,741 in which a corona discharge is used to generate electronically excited atoms or vibrationally excited molecules (metastable species) from introduced gas molecules (primarily helium) that interact with gas in the ion source volume and the evaporated sample to form analyte ions through APCI or direct ionization gas phase reactions. The resulting ions are sampled into vacuum through an orifice driven by gas flow but no applied electric fields. In an alternative embodiment of the present invention, an APCI probe comprising a corona discharge provides reagent ions from both liquid and gas reagent chemical species supplied at the APCI probe inlet end. This APCI probe is configured according to the invention in a multiple function atmospheric pressure ion (API) source. Solid, liquid or gas phase samples introduced into this remote reagent APCI source are efficiently ionized, transferred into vacuum and mass to charge analyzed.

SUMMARY OF THE INVENTION

In accordance with one embodiment of the present invention, an Atmospheric Pressure Chemical Ionization source comprising a sample inlet probe, a heater or vaporizer configured and a vapor flow channel positioned downstream the heater or vaporizer. Sample solution entering the APCI probe is nebulized with pneumatic nebulization assist. The spray of droplets produced in the nebulizer pass through a heater where they are vaporized. The sample vapor exits the APCI probe heater and enters a vapor flow channel comprising a corona discharge needle, one or more electrostatic lenses and an open exit end approximately aligned with the heater axis. The vapor flow channel geometry constrains the sample vapor from dispersing in the radial direction and directs the sample vapor through the corona discharge region. The corona discharge is maintained by applying appropriate voltages to the corona discharge needle and surrounding counter electrodes configured in the vapor flow channel. The shape of the vapor flow channel provides unrestricted flow of vapor and ions in the axial direction while containing or shielding the electric field formed by the coronal discharge. One or more electrostatic lenses configured in the vapor flow channel are positioned and shaped to focus analyte ions toward the APCI probe centerline. This centerline focusing of APCI generated ions minimizes or eliminates analyte ion losses to the walls of the vapor flow channel. Ions exiting the vapor flow channel are further focused toward the centerline by external electric fields penetrating into the vapor flow channel exit end. Voltages applied to electrodes configured in the APCI source chamber form an electric field that directs ions exiting the APCI probe into the sampling orifice into vacuum where the analyte ions are mass to charge analyzed. The invention improves APCI ionization efficiency and increases ion transmission efficiency into vacuum. Significantly improved APCI MS signal intensity is achieved using the APCI source configured and operated according to the invention when compared to APCI MS performance using a conventional APCI source configuration. Alternative embodiments of the APCI source configured according to the invention comprise two solution nebulizer inlet assemblies, an upstream ball separator and expanded vapor channel geometries incorporating corona discharge needle position adjustment to improve APCI MS performance for different analytical applications.

In another embodiment of the present invention a multiple function APCI source is configured with a shielded corona discharge APCI probe configured according to the invention and means to introduce solid, liquid and/or gas phase samples separate from the APCI inlet probe. The solid, liquid or gas sample probe positions the separately introduced sample to be ionized near the exit of the APCI probe vapor flow channel. Heated gas and reagent ions exiting the APCI probe vaporize the liquid or solid sample and produce ions through Atmospheric Pressure Chemical Ionization Reagent ions colliding with gas phase analyte molecules form analyte ions in the APCI source chamber. Voltages applied to electrodes configured in the APCI source chamber form electric fields that direct the analyte ions toward the orifice into vacuum. Analyte ions are directed into and through the sampling orifice into vacuum by the applied electric fields and neutral gas flow. Reagent ions are formed from a reagent solution or one or more reagent gases or a combination of reagent liquid and gases introduced at the APCI probe inlet end. Reagent liquid introduced into the inlet of the APCI probe configured according to the invention is nebulized and vaporized and subsequently passed through the corona discharge to form reagent ions. Reagent ions or focused toward the APCI probe centerline by applied electrostatic fields and gas flow prior to exiting the vapor flow channel. The electrostatic field and gas flow direct the reagent ion beam to impinge on the solid, liquid or gas positioned downstream of the APCI probe exit opening to maximize ionization efficiency. The vapor flow channel shields the APCI source chamber from the corona discharge electric fields, allowing the optimization of electrostatic fields formed in the APCI source chamber that direct analyte ions into the sampling orifice into vacuum. The multiple function APCI source configured according to the invention may include one or more solid sample probes, liquid sample probes and/or gas inlets. Gas samples may be drawn through the multiple function APCI source chamber using a gas flow pump on the source chamber outlet or gas sample can be introduced from a gas chromatography column or manually through a gas injection port. The multiple function APCI source can also be operated in liquid sample flow APCI, for example from a Liquid Chromatogram, with sample solution introduced into the APCI probe inlet In yet another embodiment of the invention, a combination Electrospray (ES) and APCI source comprising an APCI probe configured according to the invention and an Electrospray inlet probe is interfaced to a mass spectrometer. The combination ES and APCI source can be operated in Electrospray only, APCI only or combined ES ionization and APCI modes. The Electrospray inlet probe is configured with pneumatic nebulization assist. The Electrospray inlet probe and the corona discharged shielded APCI probe are configured in the combination ES and APCI source chamber so that the nebulized Electrospray plume passes first by the sampling orifice centerline and second into the APCI probe exit end. Heated gas exiting the APCI probe further evaporates the liquid droplets contained in the Electrospray plume and the resulting vapor is ionized as it passes through the corona discharge region by reagent ions generated in the APCI probe. APCI can be turned off by setting the voltage applied corona discharge needle to zero volts. Electrospray ionization can be stopped and started by changing the voltage on the combination ES and APCI source endplate and capillary entrance electrode. The combination ES and APCI source allows the introduction of a separate reagent ion species through the APCI probe, not formed from the nebulized or Electrosprayed sample solution. Heat to vaporize the nebulized or Electrosprayed plume is added from a heated sheath gas introduced concentric to the ES inlet probe, heated gas or vapor introduced through the APCI probe and heated counter current drying gas. Electrospray ions are formed from evaporating charged droplets in the Electrospray plume and are directed to the sampling orifice into vacuum by the applied electrostatic fields prior to being subjected to Atmospheric Pressure Chemical Ionization. APCI generated ions approach the orifice into vacuum from the opposite direction of the Electrospray generated ions minimizing space charge defocusing effects and minimizing charge reduction or exchange between Electrospray ions and reagent gas. Flow rate and temperature of the APCI probe heated gas flow, the heated countercurrent drying gas flow and the Electrospray probe nebulization and heated sheath gas flow are adjusted to maximize ion source performance for different sample solution compositions and flow rates and for different combination ES and APCI ion source operating modes

BRIEF DESCRIPTION OF THE FIGURES

FIG. 6A shows the corona discharge needle positioned on the APCI probe heater axis

FIGS. 9A, 9B and 9C show calculated the electric field lines and ion trajectories during simulated APCI operation for three different voltages applied to the electrodes configured in the vapor flow channel.

DETAILED DESCRIPTION OF THE PREFERRED EMBODIMENTS

Figure 1:
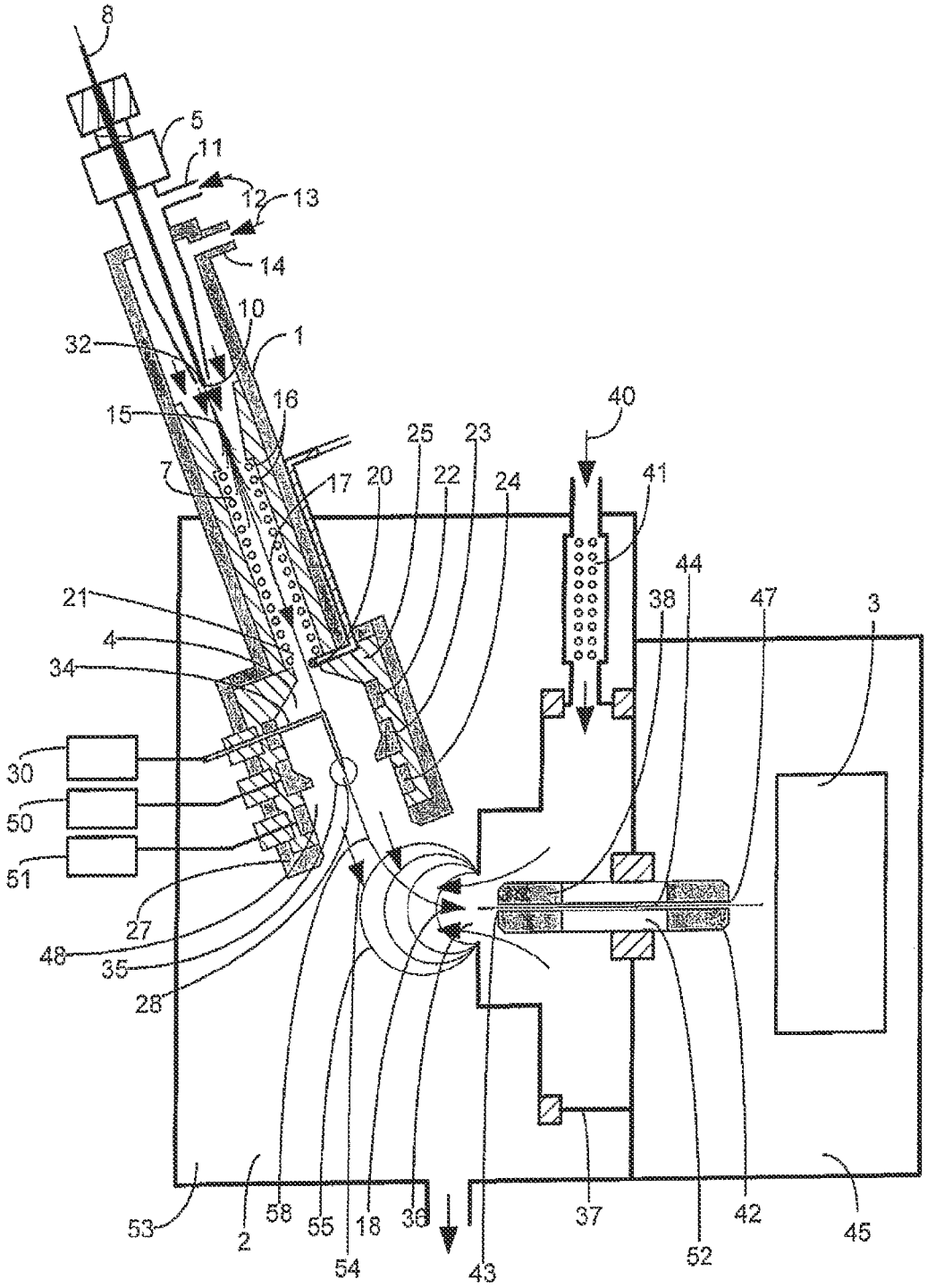
FIG. 1 is a diagram of a preferred embodiment an APCI source configured according to the invention with an APCI inlet probe comprising a sample solution nebulizer, heater and a vapor flow channel incorporating a corona discharge needle and surrounding electrodes.

A preferred embodiment of the invention diagrammed in FIG. 1 comprises Atmospheric Pressure Chemical Ionization (APCI) probe 1 configured in Atmospheric Pressure Chemical Ionization source 2 interfaced to mass spectrometer 3. APCI probe 1 comprises sample solution inlet nebulizer assembly 5, beater or vaporizer assembly 7 and vapor flow channel assembly 4. Sample solution is introduced into APCI probe 1 through sample inlet tube 8. Pneumatic nebulization of the sample solution exiting inlet tube 8 at exit end 10 forms a spray of liquid droplets 15 that is directed into heater or vaporizer 7. Nebulization gas 12 is introduced through gas inlet 11 of nebulizer assembly 5 and exits through annulus 32 surrounding inlet tube 8 exit end 10. In addition, auxiliary gas flow 13 introduced through auxiliary gas inlet channel 14 supplements nebulizer gas flow 12 in carrying nebulized sample solution droplet spray 15 into and through vaporizer 7. Nebulized droplet spray 15 evaporates as it passes through vaporizer 7 channel 17. The temperature of heater coil 16 is adjustable with a temperature controller having feedback from thermocouple 20 positioned at exit 21 of vaporizer 7 channel 17. Sample vapor exiting vaporizer channel 17 at exit end 21 enters vapor flow channel 48 of vapor flow channel assembly 4. Tip 28 of corona discharge needle 34 is positioned approximately along the centerline of vapor flow channel 48. Corona discharge needle 34, is electrically connected to cylindrical electrode 22 and to voltage supply 30. Cylindrical electrodes 23 and 24 configured in vapor flow channel assembly 4 are electrically connected to voltage supplies 50 and 51 respectively. Insulator 60 electrically insulates electrodes 22, 23, 24 and body 27. Relative voltages are set on corona discharge needle 34 and electrostatic lenses 22 and 23 during operation to sustain corona discharge 35 at selected discharge current levels and to focus exiting APCI generated ions toward the APCI probe centerline.

A portion of the vaporized solvent from the sample solution forms reagent ions as the sample solution vapor passes through and by corona discharge 35 during APCI operation. The reagent ions exchange cations or anions with vaporized analyte molecules to form analyte ions. When the voltage polarity applied to corona discharge needle 34 is positive relative to the voltage applied to cylindrical electrode 23, positive polarity reagent and analyte ions are formed. Conversely, when the voltage polarity applied to corona discharge needle 34 is negative relative to the voltage applied to cylindrical electrode 23, negative polarity reagent and analyte ions are formed During APCI operation, relative voltages are applied to corona discharge needle 34 and cylindrical electrodes 22 and 23 to sustain corona discharge 35 at a desired discharge current and to focus analyte and excess reagent ions toward the centerline of vapor flow channel 48 as they exit the APCI probe. Analyte ions exiting vapor flow channel 48 are further focused toward the centerline of APCI probe 1 by the penetration of electric field 55 into the exit end of vapor flow channel 48. Analyte ions exiting vapor flow channel 48 are directed toward entrance 43 of dielectric capillary 52 orifice 44 by electric field 55 formed from voltages applied to endplate and nose piece electrode 37 and capillary entrance electrode 38. Heated counter current drying gas flow 36 heated by gas heater 41 exits through opening 18 in endplate electrode 37. APCI generated ions 58 are directed toward capillary orifice entrance 43 driven by electric field 55. Ions 58 move against counter current drying gas 36, typically nitrogen, which prevents condensation of the hot vapor and prevents neutral solvent vapor from entering vacuum. Counter current gas flow 37 also aids in focusing ions by slowing down ion trajectories, which facilitates ion trajectories to follow focusing electric field 58. Ions entering dielectric capillary orifice or channel 44 are swept into vacuum 45 by the neutral gas flow from atmospheric pressure. A portion of the analyte ions that enter vacuum are mass to charge analyzed by mass to charge analyzer 3. Mass to charge analyzer 3 may be any type including but not limited to a quadrupole, triple quadrupole, three dimensional ion trap, linear ion trap, Time-Of-Flight, Fourier Transform, Orbitrap or Magnetic Sector mass spectrometer. Sample solution introduced through inlet tube 8 may be supplied from but not limited to Liquid Chromatograms, Ion Chromatograms or syringe pumps.

Figure 4:
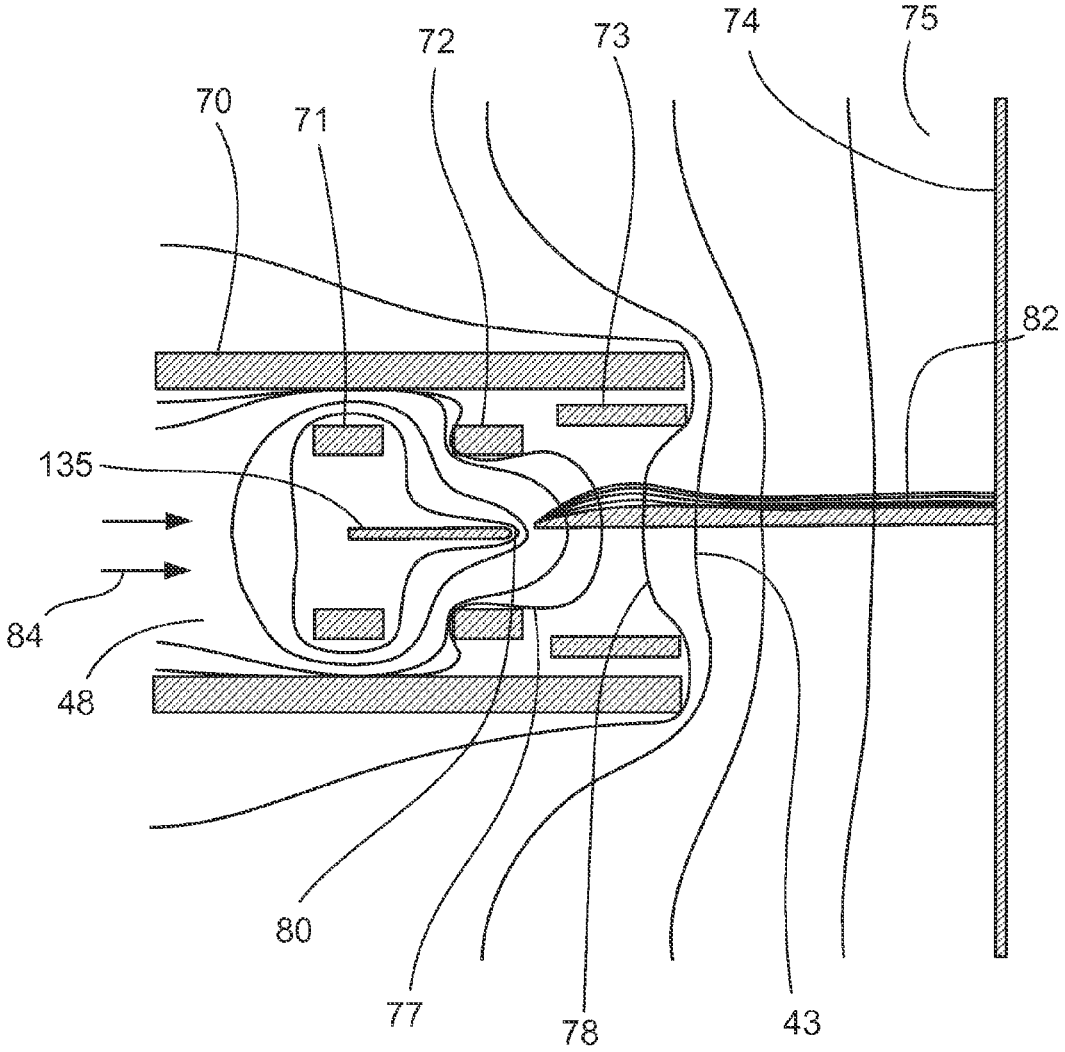
FIG. 4 is a cross section diagram of one embodiment of the APCI probe configured according to the invention showing the calculated electric field lines and ion trajectories during simulated APCI operation.

Dielectric capillary 52, described in U.S. Pat. No. 4,542,293 and incorporated herein by reference, decouples the entrance 43 and exit 47 ends both physically and electrostatically. Ions entering capillary orifice 44 at entrance end 43 have a potential energy approximately equal to the voltage applied to capillary entrance electrode 38. Ions exiting orifice 44 at exit end 47 have potential energy approximately equal to the voltage applied to capillary exit electrode 42. Ions pushed through capillary orifice 44 by the expanding neutral gas flow can have a higher exit potential energy by thousands of volts compared with the entrance potential energy. Consequently, voltages can be applied to endplate electrode 37 and capillary entrance electrode 38 that maximizes analyte ion focusing into capillary orifice 44 while maintaining APCI probe inlet tube 8 at ground potential Ions are delivered into vacuum at optimal potentials for the mass to charge analyzer employed In a preferred embodiment of APCI probe 1, body 27 of vapor flow channel assembly 4 and sample inlet tube 8 are operated at ground potential. Negative polarity potentials are applied to endplate electrode 37 and capillary entrance electrode 38 when positive polarity ions are generated with APCI. Positive polarity voltages are applied to endplate electrode 37 and capillary entrance electrode 38 when negative polarity ions are generated. Alternatively, APCI probe assembly 1 can be configured where voltage are applied to vapor flow channel body 27 to optimize ion focusing into orifice 44. Capillary 52 may be alternatively configured as a conductive heated capillary, nozzle or thin orifice into vacuum Vapor flow channel assembly 4 is configured to surround corona discharge needle 34 which partially contains or shields the corona discharge 35 electric field during operation. Shielding the corona discharge electric field from ion focusing electric field 55 in APCI source chamber 53 allows optimal focusing of analyte ions into capillary orifice 44. The open end of vapor flow channel 48 allows penetration of electric field 55 into the entrance of vapor flow channel 48. The penetration of electric field 55 focuses ions exiting vapor flow channel 48 and directs ions toward entrance 43 of capillary orifice 44. This ion focusing is illustrated in FIG. 4 FIG. 4 is a diagram of calculated electrostatic field lines and ion trajectories through vapor flow channel 48 using voltages typically applied to electrodes in APCI probe 1 configured according to the invention. Referring to FIG. 4, cylindrical electrode 71 is electrically connected to corona discharge needle 81. Although having slightly different cross section shapes, cylindrical electrodes 71, 72 and 73, grounded body 70, corona discharge needle 81 and electrode 74 are configured and operated similar to electrodes 22, 23 and 24, body 27, corona discharge needle 34 and endplate electrode 37 shown in the embodiment of the invention diagrammed in FIG. 1. FIG. 4 is a diagram of electric field lines 75 and ion trajectories 82 for simulated positive ion polarity APCI operation. Voltages of +3,000 V, 0 V, 0 V, 0V and −1,500 V are applied to electrodes 71/81, 72, 73, 70 and 74 respectively in the electric field and ion trajectory calculations. As shown in FIG. 4, electric field lines 78, formed from the applied voltages, extend into exit end 54 of vapor flow channel 48 and focus analyte ions exiting vapor flow channel 48 toward the centerline of vapor flow channel 48. The trajectories of ions generated near corona discharge needle tip 80 are defocused as they move toward exit end 54 by corona discharge electric field 77. APCI analyte and reagent ions move toward exit end 54 due to electric fields 77 and 78 and gas flow 84. Ion trajectories 82 are calculated using only electric field forces and do not take into account the additional focusing forces of the gas flow through vapor flow channel 48. In the embodiments shown in FIGS. 1 and 4, cylindrical electrodes 24 and 73 respectively are configured with a larger inner diameter larger than electrodes 23 and 72 respectively. This increased inner diameter at exit end 54 allows deeper penetration of focusing electric fields 78 and minimizes ion contact with electrode 73 which would cause neutralization of charge. Electric field 77 formed by corona discharge 35 is shielded from extending radially and partially shielded in the down stream direction leading to APCI source chamber 53 Ions exiting vapor flow channel 48 are free to follow optimized focusing electric fields toward entrance 43 of capillary orifice 44. Electrode geometry, applied electrode voltages and vapor flow channel geometry and gas flow maximize the ionization efficiency, focusing and transmission of APCI generated ions from APCI probe 1 to entrance 43 of capillary orifice 44.

Figure 2:
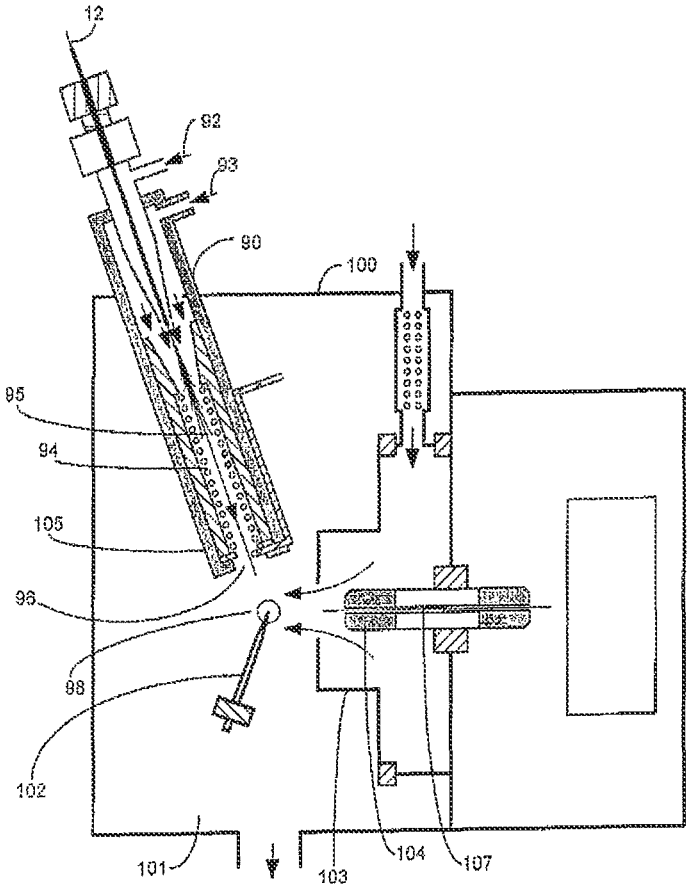
FIG. 2 is a diagram of a conventional APCI source configuration interfaced to a mass spectrometer.

In conventional APCI ion source geometries as diagrammed in FIG. 2, sensitivity decreases rapidly with sample solution flow rate for the same amount of analyte injected. In the present invention, constraining the flow of vaporized sample solution as it exits heater 7 in vapor flow channel 48 improves APCI efficiency, even for lower sample solution flow rates below 10 μl/min, when compared to the performance of conventional APCI source geometries. A conventional APCI source 100 is diagrammed in FIG. 2. APCI inlet probe 90 configured in APCI source 100, comprises sample solution inlet tube 91, nebulizer gas inlet 92, auxiliary gas inlet 93 and heater 94. Pneumatic nebulized spray 95 is vaporized in heater 94 and exits at exit end 96 into APCI source chamber 101. A portion of the vapor passes through and around corona discharge 98 formed at the tip of corona discharge needle 102 during APCI operation. With APCI inlet probe body 105 maintained at ground potential, relative voltages applied to corona discharge needle 102, endplate electrode 103 and capillary entrance electrode 104 establish and maintain corona discharge 98. These applied voltages must also be set to optimize ion focusing into capillary orifice 107 As shown in FIG. 4, the corona discharge electric field causes defocusing of ion trajectories. In conventions APCI source 100, corona needle 102 position and the electrode applied voltages are set to optimize performance but such optimization is a compromise between ionization efficiency and ion transport efficiency. Analyte vapor exiting heater 94 disperses in APCI source chamber 101, decreasing ionization efficiency. The compromise between corona discharge intensity and ion focusing electric fields results in reduced signal intensity. The embodiment of the invention as diagrammed in FIG. 1 simultaneously increases Atmospheric Pressure Chemical Ionization efficiency and ion transmission efficiency into vacuum significantly improving APCI MS performance.

Figure 3A:
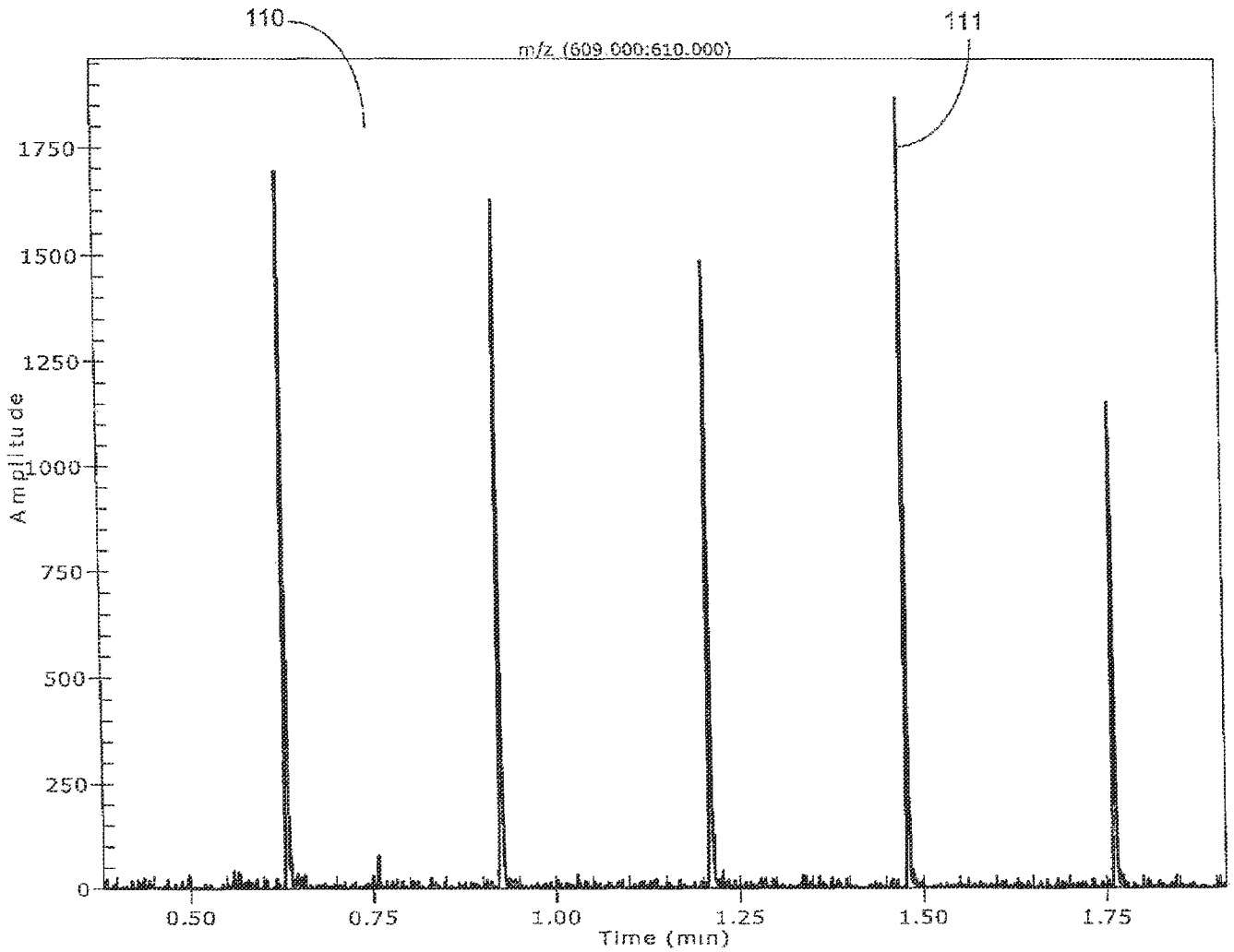
FIG. 3A is a Base Ion Chromatogram (BIC) of 1 μl injections of 1 pg of Reserpine in 1:1 Water/Methanol with 0.1% Acetic Acid solutions at a flow rate of 1 ml/min using the embodiment of the invention similar to that diagrammed in FIG. 1.
Figure 3B:
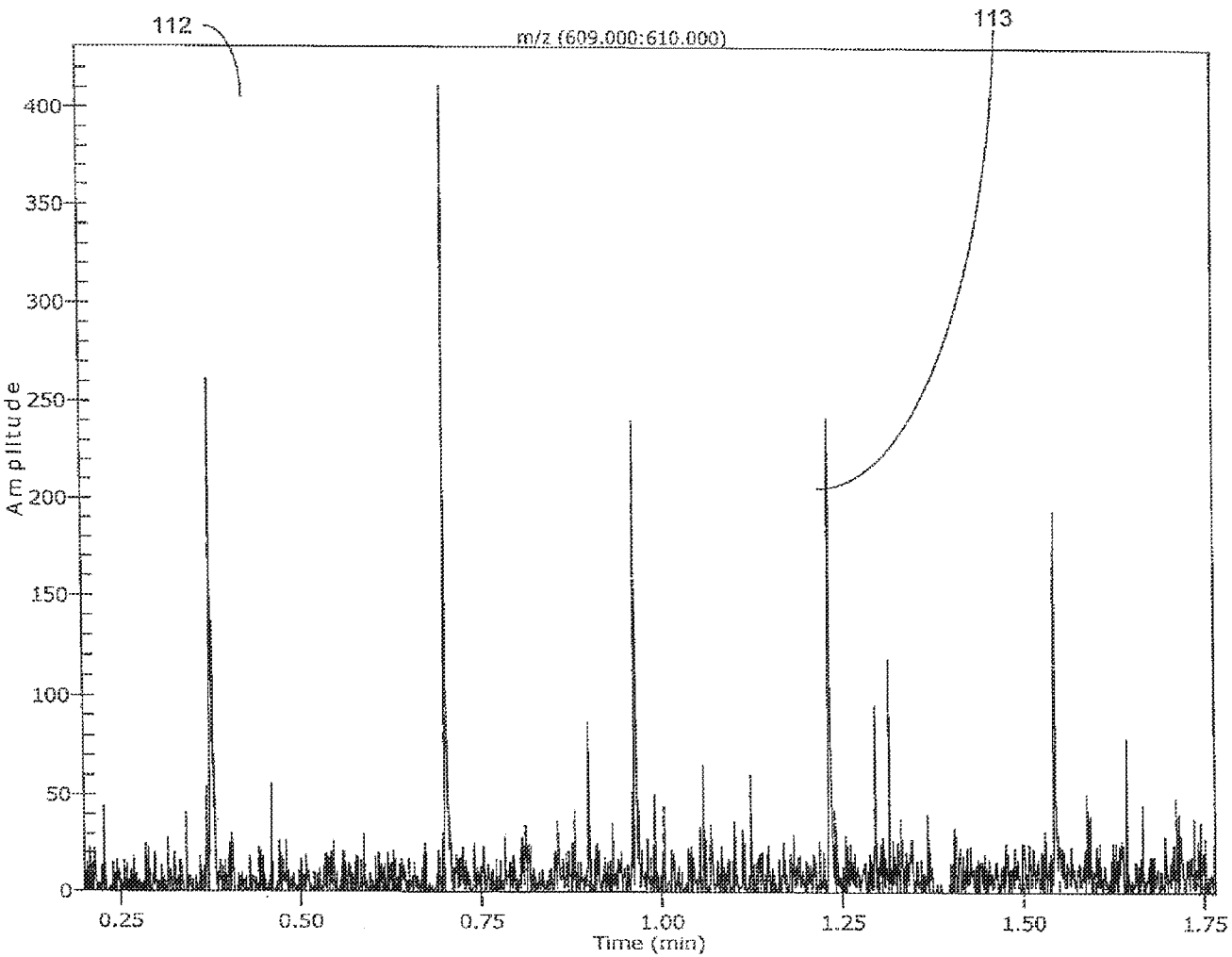
FIG. 3B is a BIC of the Reserpine using the same injection, sample solution and flow conditions as in 3A but acquired using a conventional APCI source similar to that diagramed in FIG. 2.

FIG. 3A shows Base Ion Chromatogram (BIC) 110 containing multiple peaks 111 of 1 μl injections of 1 pg of Reserpine in a 1:1 water/methanol with 0.1% acetic acid solution using the APCI source embodiment of the invention diagrammed in FIG. 1. The sample solution flow rate into sample solution inlet tube was 1 ml/min. FIG. 3B shows BIC 112 containing multiple peaks 113 of 1 μl injections of the same Reserpine sample solution flow at the same flow rate into a conventional APCI source configured as diagrammed in FIG. 2. For each BIC 110 and 112, Time-Of-Flight MS mass spectra were acquired at a rate of 20 spectra per second. APCI source 2 configured according the invention shows an increase in analyte signal intensity by more than six times and improved signal to noise by more than ten times when compared to the performance of a conventional APCI source. APCI source 2 configured according to the invention also exhibited increased sensitivity at lower sample solution flow rates when compared to the performance of a conventional ion source as summarized in Table 1 for positive polarity ion generation.

TABLE 1

| Flow Rate | Reserpine 2 fM/μL | Indole 1 pM/μL | Indole 10 pM/μL | Progesterone 10 pM/μL | Cortisone 10 pM/μL |
|---|---|---|---|---|---|
| 5 μL/min | 40:508 | noise:5K | 8.6K:36K | 9.7K:49K | 6.4K:39K |
| 10 μL/min | 80:987 | noise:10K | 14.7K:71KL | 18.2K:94K | 12.7K:74K |
| 20 μL/min | 149:1.8K | noise:14.8K | 26K:125K | 32K:150K | 25.2K:75K |
| 40 μL/min | 318:3.8K | noise:24K | 46K:191K | 58K:267K | 44.5K:214K |
| 80 μL/min | 632:6.8K | 8.4K:22.6K | 65K:200K | 8.3K:390K | 59K:301K |
| 120 μL/min | 661:10K | 7.5K:12K | 58K:140K | 70K:402K | 46K:296K |
| 200 μL/min | 680:9.1K | 6.5K:13K | 49K:141K | 58K:467K | 36K:276K |

The first number in each column is the APCI MS signal intensity measured when using a convention APCI source and the number following the colon in each column is the APCI MS signal intensity measured when using an APCI source configured according to the invention as diagrammed in FIG. 1.

The APCI source configured and operated according to the invention exhibited significant improvements in performance for negative polarity ion generation compared with the performance of a conventional APCI source as shown in Table 2.

TABLE 2

| Flow Rate | Reserpine 2 fM/μL | Cortisone 10 pM/μL |
|---|---|---|
| 5 μL/min | 46:256 | 304:5.5K |
| 10 μL/min | 92:517 | 435:14K |
| 20 μL/min | 137:927 | 1.3K:27K |
| 40 μL/min | 173:893 | 3.8K:58K |
| 80 μL/min | 138:713 | 8.8K:120K |
| 120 μL/min | noise:239 | 6.6K:161K |
| 200 μL/min | noise:193 | 4.8K:142K |

Again, the first number in each column is the APCI MS signal intensity measured when using a convention APCI source and the number following the colon in each column is the APCI MS signal intensity measured when using an APCI source configured according to the invention as diagrammed in FIG. 1.

Figure 5:
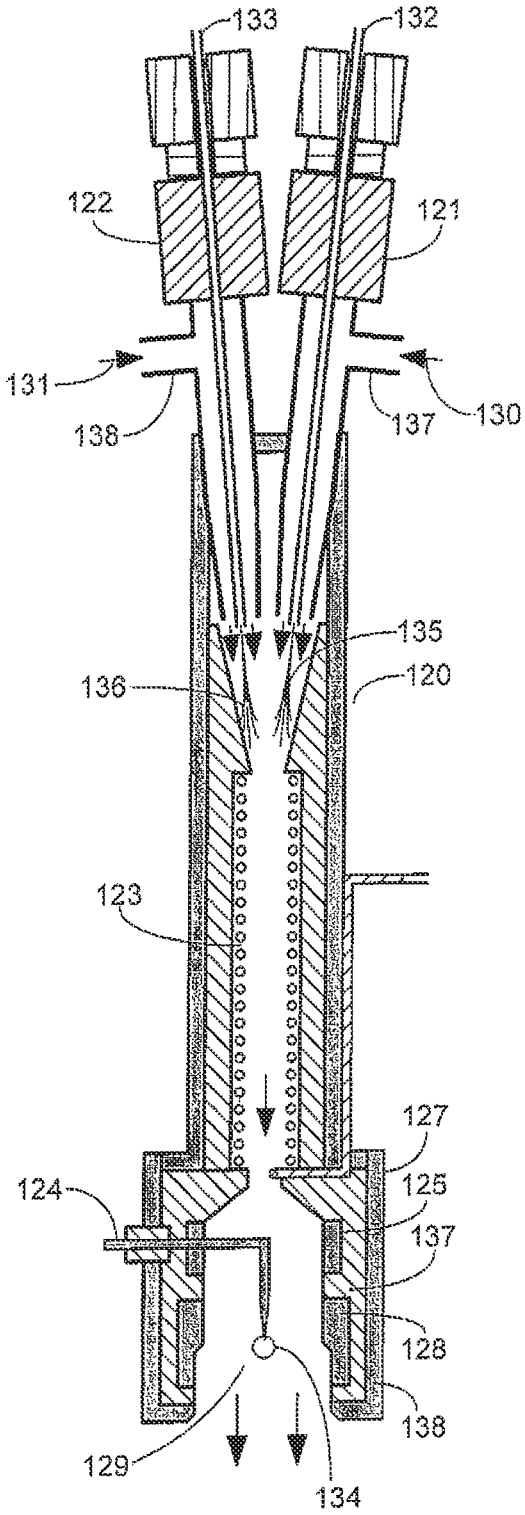
FIG. 5 is a cross section diagram of an alternative APCI probe embodiment wherein two sample solution inlets are configured in an APCI inlet probe comprising a heater and vapor flow channel configured with a corona discharge needle and one focusing electrode.

An alternative embodiment to the invention is diagrammed in FIG. 5. APCI probe 120 is configured with two sample solution inlet nebulizer assemblies 121 and 122. Two sample solutions or a sample solution and a calibration solution can be introduced into APCI probe 120 simultaneously through sample inlet tubes 132 and 133. Pneumatic nebulization gas 130 and 131 enter inlet nebulizer assemblies 121 and 121 through channels 137 and 138 respectively. Solutions flowing through sample solution inlet tubes 132 and 133 form pneumatic nebulized sample sprays 135 and 136 respectively that flow into heater or vaporizer 123 as a mixture. The dual sample spray mixture or the sample and calibration spray mixture evaporates as it passes through heater 123. The vapor exiting heater 123 passes through and around corona discharge 134 as it passes through vapor flow channel 129 in vapor flow channel assembly 127. Dual inlet APCI probe 120 can be operated with sample solution and or calibration solution introduced simultaneously or individually through inlet tubes 132 and 133. Dual inlet APCI probes configured without vapor flow channel assemblies are described in U.S. Pat. No. 6,207,954 B1 incorporated herein by reference Adding a second calibration solution simultaneously with a sample solution allows acquisition of sample and calibration peaks in the acquired mass spectrum without mixing the calibration solution directly into the sample solution. Calibration peaks in the acquired spectrum serve as an internal standard to improve mass measurement accuracy. When the calibration and sample solutions are introduced through separate inlet probes, no sample to calibration solution liquid phase interaction occurs which can modify the sample solution composition. Also no contamination of the sample solution flow line by the calibration solution occurs, reducing flushing and cleaning time.

Dual sample or sample and calibration solutions can be introduced through inlet tubes 132 and 133 simultaneously or individually. For example the calibration solution can be introduced before and after a Liquid Chromatography Mass Spectrometer (LC/MS) run to bracket the LC/MS data with calibration spectra, improving mass measurement accuracy. Calibration solution is first introduced through inlet tube 133 prior to starting an LC/MS run. The calibration solution flow is then turned off while sample solution continues to flow through inlet tube 132 during the LC/MS run. After the LC/MS run is complete, the calibration solution flow is turned on to acquire calibration mass spectrum Calibration mass spectrum acquired before and after the LC/MS run are averaged to provide an accurate external calibration reference Alternatively, the calibration solution flow can remain turned on during the LC/MS run to provide an internal mass measure calibration standard in the acquired mass spectra.

Vapor flow channel assembly 127 configured according to the invention, partially encloses corona discharge needle 124 and shields the APCI source chamber from the electric field formed by corona discharge 134. A preferred embodiment of the invention is shown in FIG. 5 wherein vapor flow channel assembly 127 comprises two cylindrical electrodes 125 and 128 compared with the three cylindrical electrode, 22, 23 and 24 embodiment of the invention shown in FIG. 1. Cylindrical electrode 125 is electrically connected to corona discharge needle 124 and electrically insulated from cylindrical electrode 128 by insulator 137. Relative voltages applied to corona needle 124 and electrode 128 form corona discharge 134 as sample vapor or sample and calibration mixture vapor flow through vapor flow channel 129. The reduced number of electrodes configured in vapor flow channel assembly 127 reduces cost and complexity, requiring one less voltage supply and related electronic and software controls. APCI probe assembly 120 can be configured in an APCI source assembly similar to APCI source assembly 2 shown in FIG. 2, interfaced to a mass spectrometer.

Figures 6A, 6B:
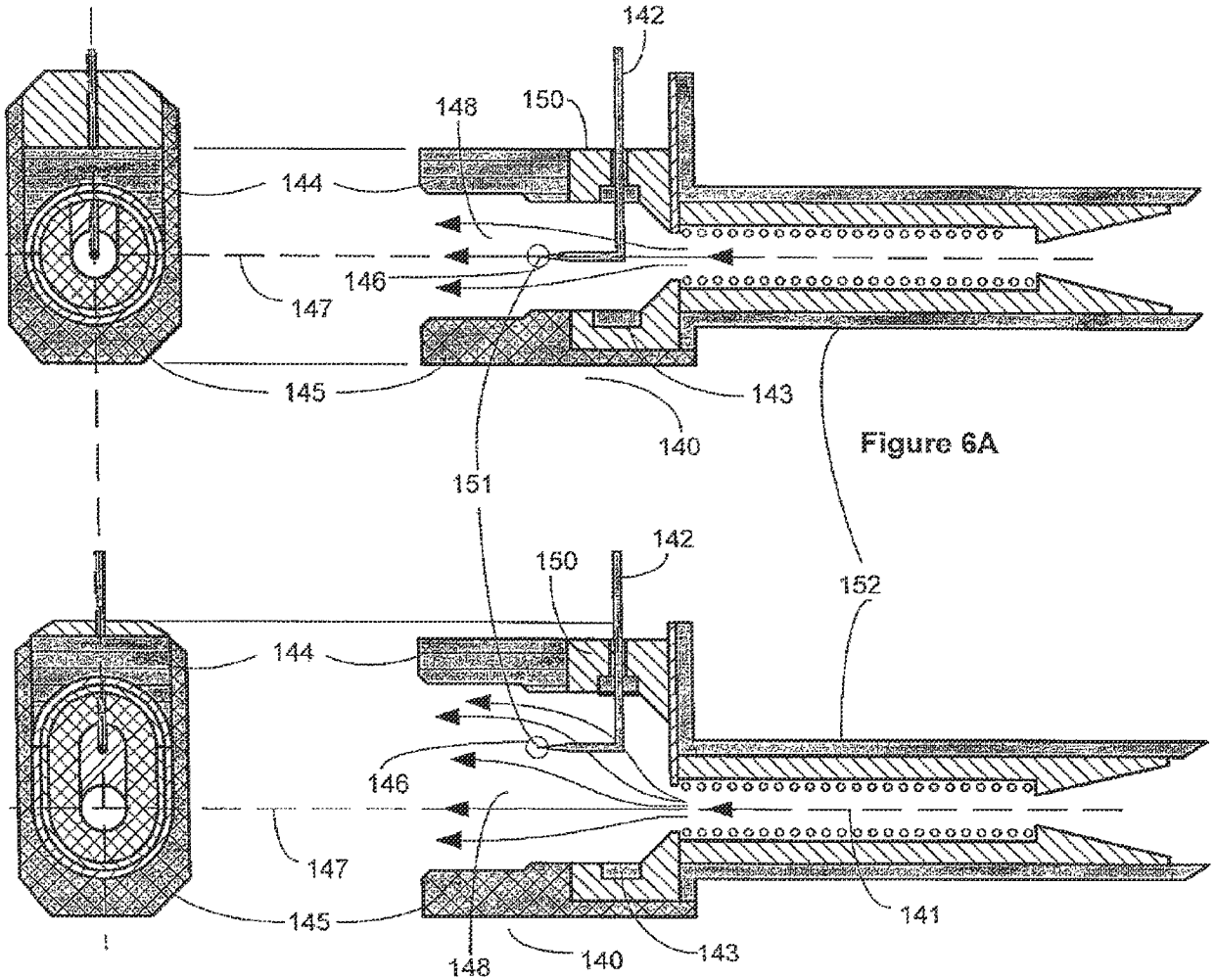
FIG. 6A is a cross section of an alternative embodiment of the invention wherein the vapor flow channel opening geometry and the corona discharge needle position are adjustable.
FIG. 6B is a cross section of the embodiment of the invention diagrammed in FIG. 6A with the corona needle position adjusted off the heater axis and the vapor flow channel adjusted to an expanded vapor flow channel size.

An alternative embodiment to the invention diagrammed in FIGS. 6A and 6B allows optimization of APCI performance when running higher solution flow rates. Vapor flow channel assembly 140 is configured with movable elements, electrode 144, insulator 150 and corona discharge needle 142 which allows adjustment of the vapor flow channel shape and corona needle position. Electrode 144 and insulator 150 can be move in or out to contract or expand vapor flow channel 148 opening size. Moving electrode 144 and insulator 150 in towards heater centerline 147 forms an axially symmetric vapor flow channel 148 centered around vaporizer and APCI probe axis 147 as diagrammed in FIG. 6A. Positioning electrode 148 and 150 away from axis 147 forms an elongated vapor flow channel 148 as diagrammed in FIG. 6B. The position of corona discharge needle 142 is adjustable with sufficient range to locate corona discharge needle tip approximately on APCI probe and heater centerline 147 or more than one heater exit diameter off centerline 147. The adjustable vapor flow channel opening 148 shape and corona discharge needle position allows stable corona discharge operation at higher sample solution flow rates. At higher sample solution flow rates, typically above 1 ml/min, the nebulized spray may not be fully evaporated by heater 141 resulting in liquid droplets passing through corona discharge 146. Droplets may pick up charge from corona discharge 146 but remain as incompletely evaporated charged liquid droplets that can enter vacuum and cause signal noise spikes in the acquired mass spectrum. Also, liquid droplets passing through corona discharge 146 can destabilize the corona discharge current resulting in fluxuating APCI MS signal. Expanding the cross section of vapor flow channel 148 and adjusting the position of corona discharge needle tip 151 off centerline 147 allows operation of corona discharge 146 outside the stream of partially evaporated droplets that can occur at higher sample solution flow rates. APCI probe 152, configured according to the invention can be positioned relative to the sample orifice into vacuum to preferentially deliver ions formed in the corona discharge region while minimizing the sampling of partially evaporated charged droplets into vacuum Electrode 143 is electrically connected to corona needle 142 Vapor flow channel electrode elements 144 and 145 are electrically connected and form the shielding counter electrode surrounding corona discharge needle tip 151. Electrodes 144 and 145 are typically run at ground potential. Voltage is applied to the corona discharge needle 142 to form corona 146 at corona needle tip 151. As described for the embodiment of the invention diagrammed in FIG. 1, vapor flow channel 148 is open at its exit end to allow penetration of focusing electric fields formed from voltages applied to APCI source electrodes. The shaping of electrodes 144 and 145 provide shielding of the corona discharge electric field while providing focusing and maximum transmission of APCI generated analyte ions.

Figure 7:
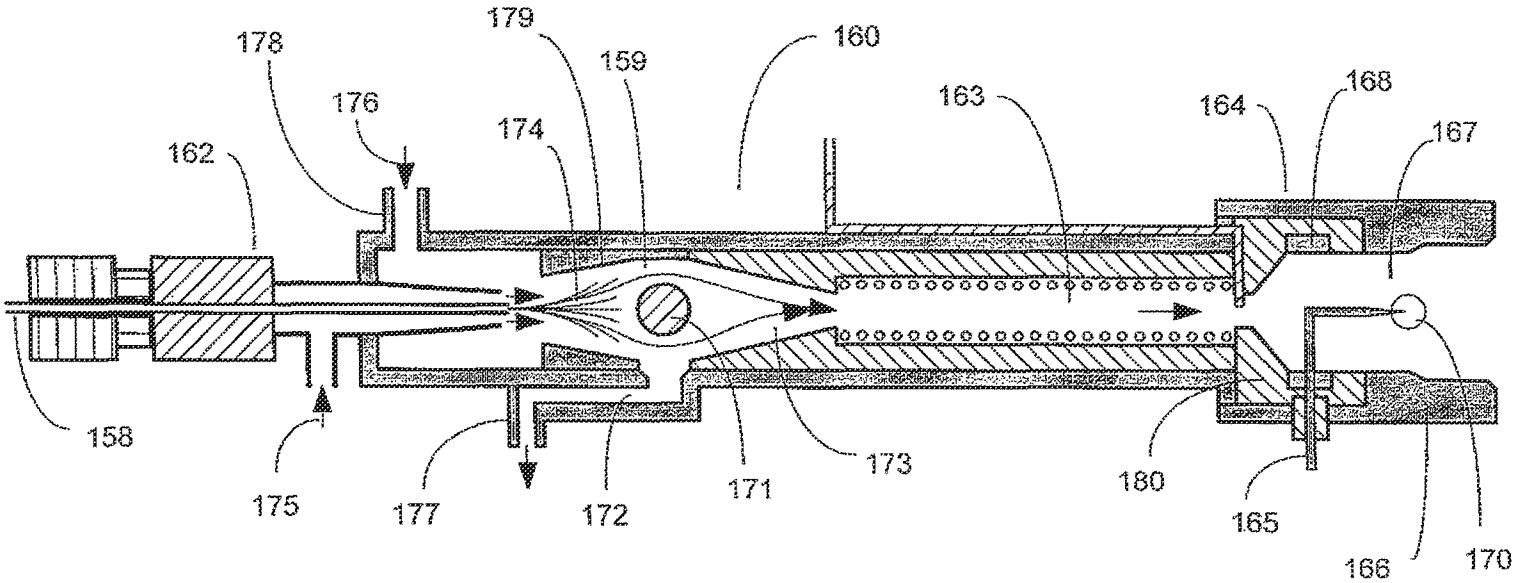
FIG. 7 is a cross section diagram of an APCI probe configured according to the invention comprising a spray droplet ball separator upstream of the vaporizer heater.

FIG. 7 is a diagram of an alternative embodiment of the invention wherein droplet separator ball 171 is configured in sample spray 174 flow path upstream of heater or vaporizer 163. At higher sample liquid flow introduced through inlet tube 158, pneumatic nebulizer assembly 162 with nebulizer gas 175 and nebulizer gas inlet 181, may form a wide distribution of droplet sizes. The larger droplets formed in pneumatic nebulized spray 174 may not fully evaporate as they move through heater 163 before passing through vapor flow channel 167 with corona discharge 170. As described in the alternative embodiment of the invention shown in FIGS. 6A and 6B, partially evaporated droplets passing through or by corona discharge 170 may cause instability in corona 170 and undesired noise spikes in acquired mass spectra. In APCI probe 160, larger droplets entrained in spray 174 will impact on ball separator 171 while smaller nebulized droplets in spray 174 will pass around ball separator 171. Sample liquid buildup on separator ball 171 drops into drain 172 where the excess liquid is removed through channel 177. Ball separator flow channel 159 comprises an expanding section 179 and converging section 173 to minimize turbulent flow and maximize small droplet transmission into heater 163.

The flow rate of auxiliary gas flow 176 entering into ball separator region 159 through channel 178 can be adjusted to optimize the transmission of desired droplet sizes into heater 163. Alternatively, the size and downstream position of separator ball 171 can be adjusted to optimize the droplet size distribution transmission into heater 163. The embodiment of the invention diagrammed in FIG. 7 provides higher amplitude stable APCI MS signal with reduced noise compared with convention APCI configurations for higher sample solution flow rates. A preferred embodiment of vapor flow channel assembly 164 comprises one open ended cylindrical electrode 166, cylindrical electrode 168 and corona discharge needle 165. Electrode 166 is typically operated at ground potential but alternatively can be run with non zero voltage applied The shape of electrode 166 provides partial shielding of the electric field from corona discharge 170 while allowing external electric field penetration to aid in focusing of exiting APCI generated ions toward the centerline of vapor flow channel 167. Cylindrical electrode 168 is electrically connected to corona discharge needle 165 and is electrically insulated from electrode 166 by insulators 180 and 182. Insulator 180, electrodes 168 and 166 and corona discharge needle 165 are configured and operated to maximize APCI efficiency of analyte ions and maximize analyte ion transmission into vacuum for mass spectrometric analysis. Separator ball 171 configured according to the invention provides more uniform droplet size distributions entering heater 163 resulting in consistent sample vapor flow through vapor flow channel 167 over a wide range of sample solution flow rates.

Figure 8:
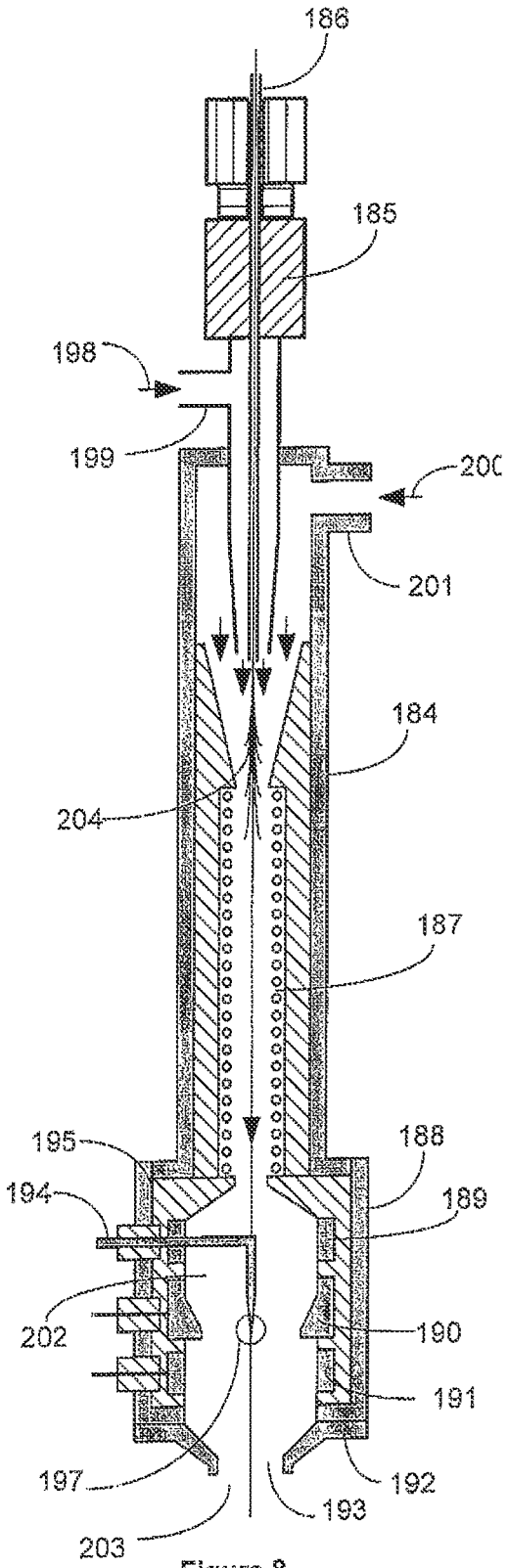
FIG. 8 is a cross section diagram of an alternative embodiment of the APCI probe wherein the vapor flow channel exit opening is reduced.

An alternative preferred embodiment of the invention is diagrammed in FIG. 8. APCI probe assembly 184 is configured to provide a source of reagent ions for Atmospheric Pressure Chemical Ionization of samples introduced internal or external to APCI probe 184 APCI probe 184 configured according the invention comprises sample inlet tube 186, nebulizer assembly 185, heater 187 and sample reagent gas or vapor flow channel assembly 188 Electrodes 189, 190 and 191 and corona discharge needle 194 are configured similar to electrodes 22, 23 and 24 and corona discharge needle 34 in APCI probe 1 diagrammed in FIG. 1. Exit opening 193 of vapor flow channel 202 is reduced by the addition of exit plate 192 compared the exit opening of vapor flow channel 48 of the embodiment of the invention diagrammed in FIG. 1. The reduced size exit opening 193 in exit plate 192 provides the delivery of a more focused flow of heated neutral gas into the APCI source chamber while retaining an exiting APCI generated ion beam that is focused toward centerline 203 of APCI probe 184. Vapor flow channel 202 is configured to shield the electric field generated by corona discharge 197. Similar to previously described embodiments of the invention, nebulizing gas 198 can be introduced through channel 199 in nebulizer assembly 185. Auxiliary gas 200 can be introduced independently through inlet channel 201 and reagent or sample solution is introduced through inlet tube 186. Solution exiting inlet tube 186 is nebulized to form droplet spray 204. APCI probe 184 can be used to generate analyte ions through APCI from sample solutions or to form reagent ions from reagent gas or reagent solutions. Combinations of reagent solutions and reagent gas can be ionized to form reagent ion mixtures used to conduct APCI of external samples. Introducing reagent solutions that are nebulized, vaporized and ionized allows tighter control of gas mixture ratios then if just reagent gas was introduced. Reagent solutions may include but are not limited to water, methanol, acetonitrile, acetone, toluene and ammonia. Nebulization or auxiliary gases may include but are not limited to air, nitrogen, helium or argon or mixtures of these gases. Different reagent species can be added to solution or gas flows into APCI probe 184 to increase ionization efficiency for specific sample molecule types.

For example, if the desired reagent ion is a hydronium ion $(H_3O)^+$, liquid phase water can be introduced through inlet tube 186, nebulized and evaporated evaporated in heater 187 forming a specific concentration of water vapor flowing through vapor flow channel 202. If the delivered liquid flow rate of water is 1.0 μl/min and nitrogen nebulizing gas is introduced through channel 199 at a flow rate of 1.2 L/min, the gas phase concentration of water would be accurately controlled at a level below 1 part per thousand. For a given combined flow rate of nitrogen nebulizer and auxiliary gas, the relative concentration of gas phase water molecules can be controlled by varying the water solution flow rate through inlet tube 186. Optimum concentrations of water will yield a higher abundance of hydronium ions and less protonated water clusters which have higher proton affinity and consequently lower efficiency as APCI reagent ions. Different solvents or solvent mixtures can be introduced through inlet tube 186 and different gas species or mixtures of gas species can be introduced through nebulizer gas inlet 199 or auxiliary gas inlet 201. The temperature of the reagent ion and neutral gas mixture leaving exit opening 193 is controlled by setting the heater temperature in heater 187. Reagent gas temperature aids in evaporating external samples, facilitating gas phase APCI processes.

Figure 9A:
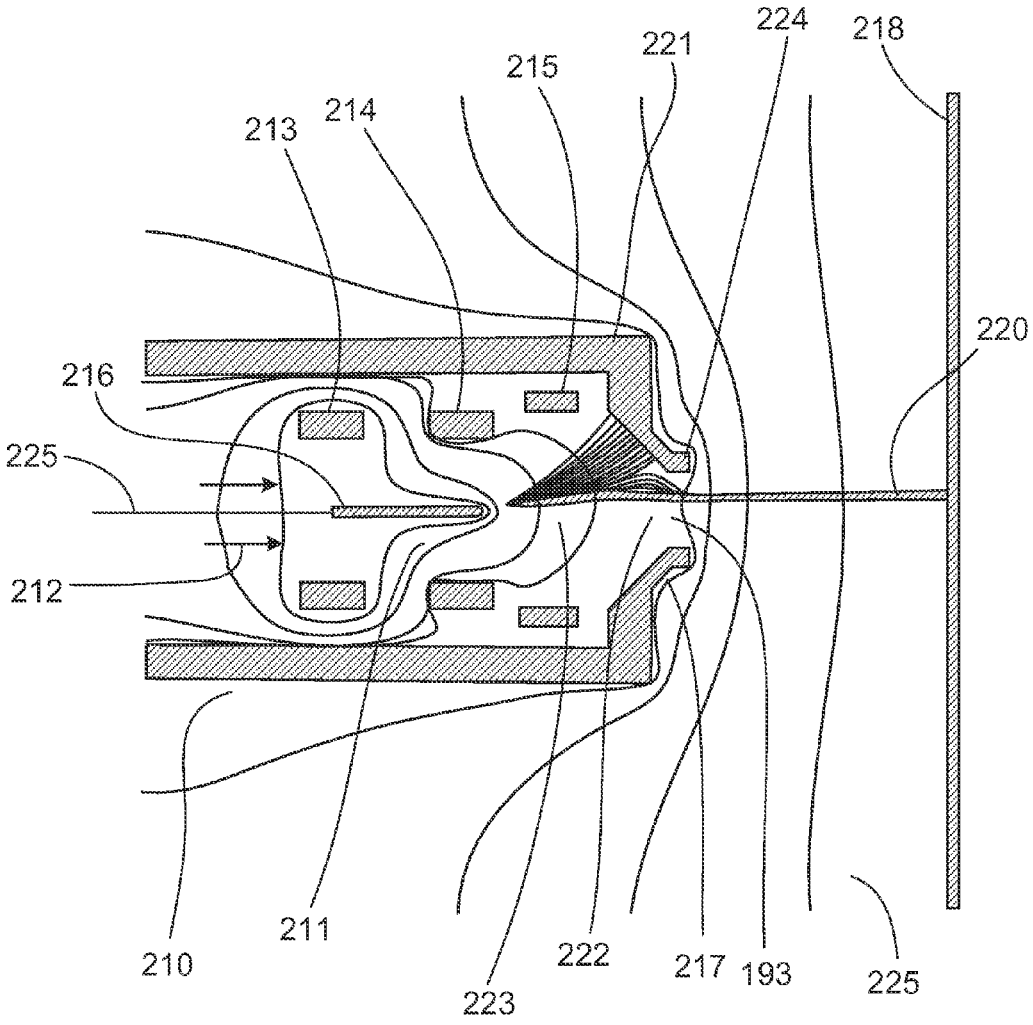
FIG. 9A through 9C are cross section diagrams of an embodiment of the vapor flow channel similar to that shown in FIG. 8.
Figure 9B:
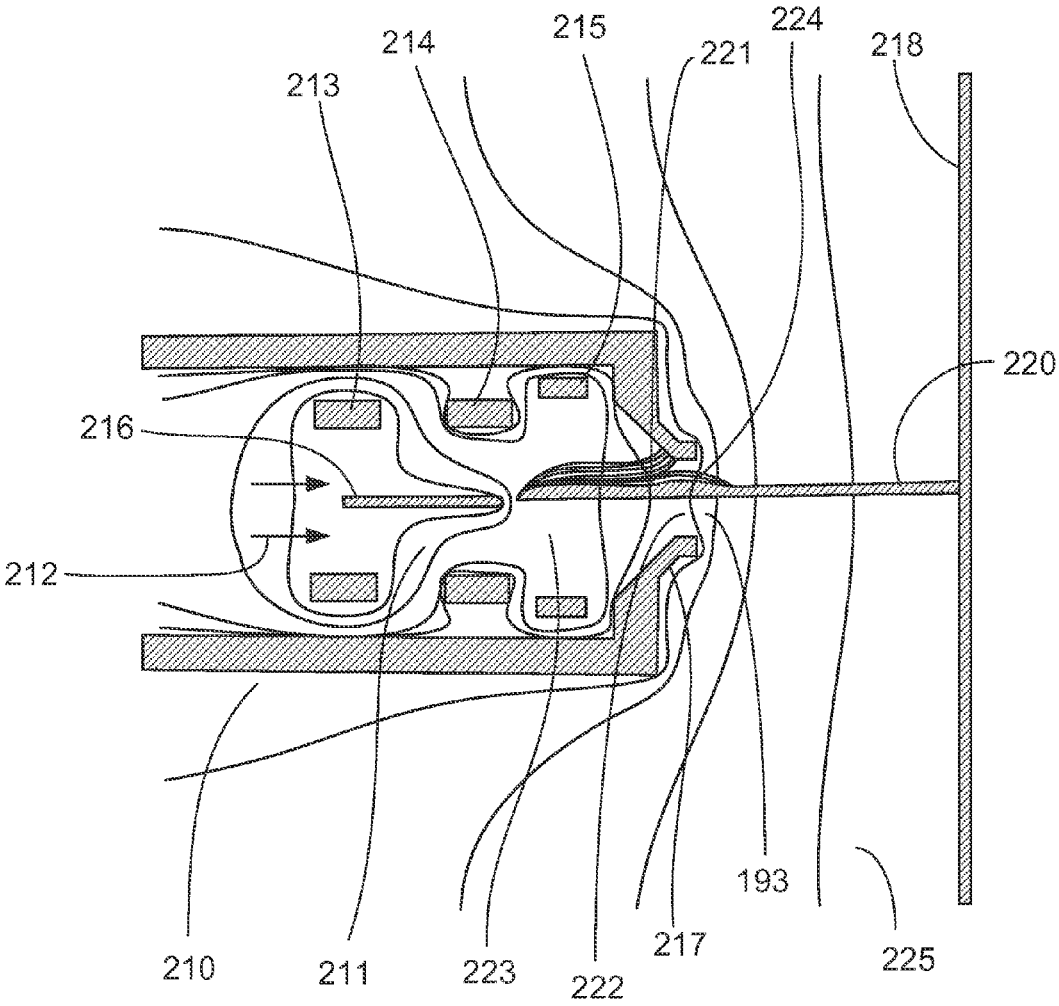
Figure 9C:
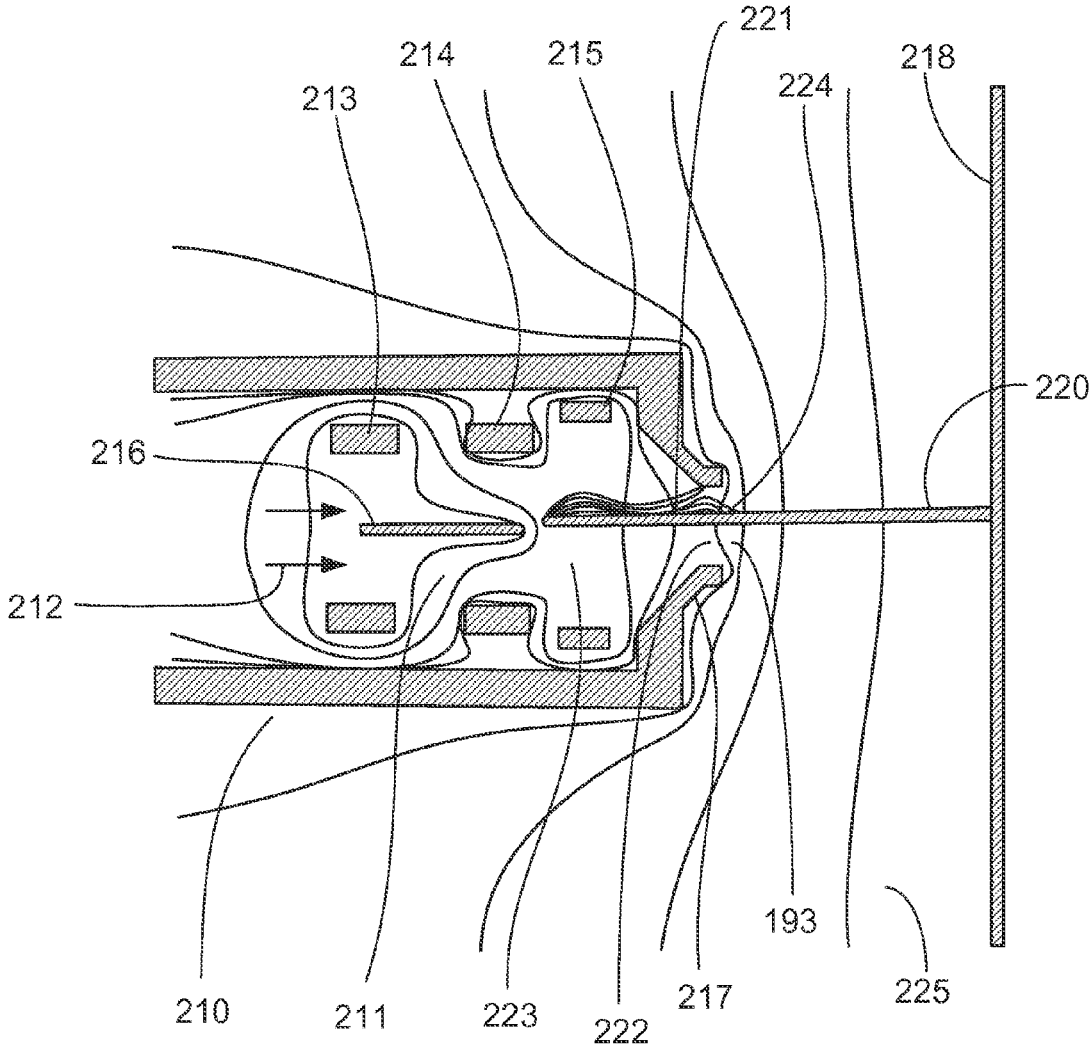

Relative voltages applied to corona discharge needle 194, cylindrical electrodes 190 and 191 and exit plate 192 can be set to focus the exiting APCI generated ions toward centerline 203. Ion focusing toward centerline 203 maximizes transmission efficiency and minimizes contamination buildup on surfaces in vapor flow channel 202. Insulator 195 electrically insulates corona discharge needle 194 and electrodes 189, 190, 191 and 192 during APCI operation. FIGS. 9A, 9B and 9C show the calculated electric fields and ion trajectories for three different focusing voltages applied to electrode 191. The calculations do not consider the additional ion focusing effects of gas flow exiting opening 193 so the actual ion trajectory focusing toward centerline 203 will be improved from that shown in FIGS. 9A, 9B and 9C. Referring to FIG. 9A, electrodes 213, 214 and 215, corona discharge needle 216 and exit plate 217 are functionally equivalent to electrodes 189, 190 and 191, corona discharge needle 194 and exit plate 192 respectively shown in FIG. 8. A portion of reagent gas or sample vapor 212 flowing through vapor flow channel 211 in vapor flow channel assembly 210 is ionized as it passes through or by the tip of corona discharge needle 216. As described above, ion trajectory calculations were based on electric fields only and do not consider vapor or gas flow 212 as an ion focusing force. In the preferred embodiment of the invention, diagrammed in FIGS. 8 and 9, gas flow 212 will additionally focus ion trajectories toward centerline 203 as the ion beam exits opening 193. In FIG. 9A, voltage values are set for the APCI generation of positive polarity ions with +3,000V, 0V, 0V, 0V and −1,500V applied to electrodes 213/corona discharge needle 216, 214, 215, 217 and 218 respectively. Ion trajectories 221 in vapor flow channel 211 initially defocus away from centerline 225 due to the corona discharge electric field 223 As ions 224 approach opening 193 they are focused toward centerline 225 due to the focusing electric field 222 penetrating into opening 193. Focusing field 222 penetrating into opening 193 is formed by the −1,500 Volts applied to counter electrode 218 relative to the ground or zero volts applied to exit plate 217. Ions formed further away from center line 225, however, impact on exit opening plate 217 for the calculated focusing conditions illustrated.

In FIG. 9B, voltage values are again set for the APCI generation of positive polarity ions with +3,000V, 0V, +500 V, 0V and −1,500V applied to electrodes 213/corona discharge needle 216, 214, 215, 217 and 218 respectively. Improved focusing of ions 221 and 224 is achieved as the voltage applied to electrode 215 diminishes defocusing electric field 223 formed by the corona discharge A higher percentage of APCI generated ions exit opening 193 forming collimated ion beam 220. In FIG. 9C, +3,000V, 0V, +1,000 V, 0V and −1,500V are applied to electrodes 213/corona discharge needle 216, 214, 215, 217 and 218 respectively. Focusing of ions 221 has improved with a high percentage of APCI generated ions passing through exit opening 193 forming collimated ion beam 220. Neutral gas flow through opening 193 will further increase the efficiency of ion transmission through opening 193. The embodiment of the invention shown in FIG. 9C provides simultaneous focusing of APCI generated ions and surrounding neutral heated carrier gas into simulated APCI source chamber 227.

Figure 10:
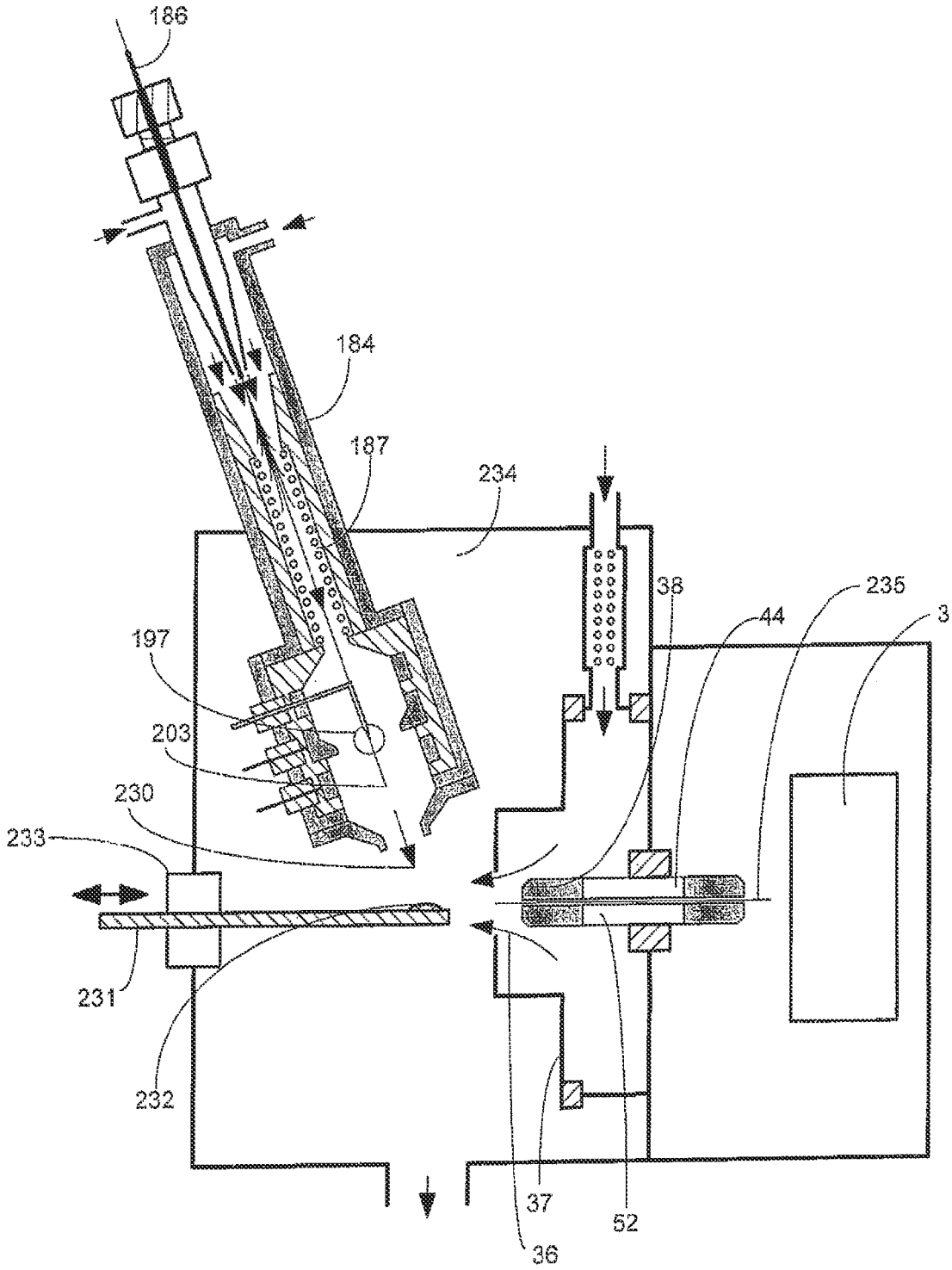
FIG. 10 is a cross section diagram of an alternative embodiment of the invention wherein an APCI source comprises an APCI inlet probe configured according to the invention supplying reagent ions to ionize solid or liquid phase sample introduced on an inlet probe.

Another preferred embodiment of the invention is diagrammed in FIG. 10, wherein multiple function APCI source 234 is interfaced to mass to charge analyzer 3. APCI source 234 comprises APCI probe 184, sample introduction probe 231, endplate electrode 37 with heated counter current drying gas flow 36, and dielectric capillary 52 with entrance electrode 38 and orifice 44. APCI probe 184 is positioned with its centerline 203 pointing at but angled to extended centerline 235 of capillary 52. Sample introduction probe 231 is inserted or removed through port 233 manually or using automated sample handling means. Sample 232 loaded onto sample introduction probe 231 can be either a liquid or solid phase. Heated reagent ions and neutral gas mixture 230 exiting APCI probe 184 generate ions through Atmospheric Pressure Chemical Ionization from evaporating or volatized molecules of sample 232. The temperature of ion and gas mixture 230 can be adjusted by setting the temperature of heater 187. The composition of reagent ions and neutral gas can be established by introducing selected nebulization gas, auxiliary gas and reagent solutions into APCI probe 184 as was described above. APCI generated sample ions are directed into capillary orifice 44 by the electric fields formed by voltages applied to endplate electrode 37, capillary entrance electrode 38, sample introduction probe 231 which may have a voltage applied and the body of APCI probe 184 which is typically run at ground potential. When the sample introduction probe is removed, APCI ionization of flowing sample solution with MS analysis can be conducted by introducing the flowing sample solution through inlet tube 186 with APCI ionization of the sample vapor as described above according to the invention. The multiple function APCI source 234 configured according to the invention can be operated as an APCI source for sample liquid flow such as from a Liquid Chromatogram with MS analysis Alternatively, APCI source 234 can be operated to generate ions by APCI of solid or liquid phase samples introduced into APCI source 234 on sample introduction probe 231 external to APCI probe 184. A portion of such APCI generated ions are transferred to vacuum and mass to charge analyzed Calibration sample can be introduced through sample inlet probe 231 to generate calibration ion for mass calibration In sample solution flow APCI MS analysis, such calibration sample introduction can be applied before, during or after an LC/MS run where sample solution flow is introduced through inlet tube 186. The flowing sample solution APCI or sample introduction probe APCI operating modes can be rapidly switched in APCI source 234 diagrammed in FIG. 10.

Figure 11:
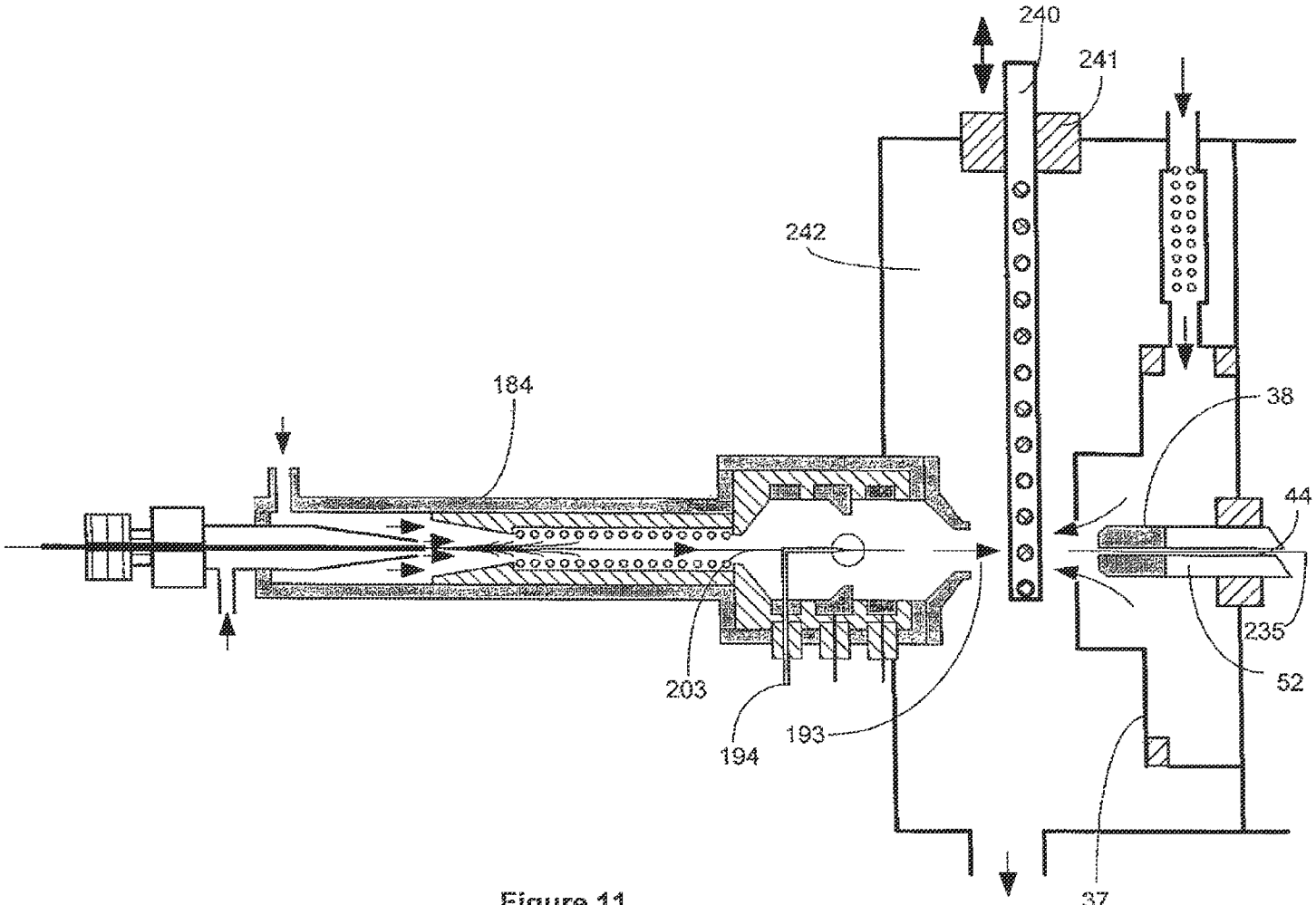
FIG. 11 is a cross section diagram of an alternative embodiment of the invention wherein an APCI source comprises and APCI inlet probe configured according the invention positioned approximately along the axis of the orifice into vacuum supplying reagent ions to ionize solid or liquid phase sample introduced on an inlet probe.

An alternative embodiment of the invention is diagrammed in FIG. 11 wherein multiple function APCI source 242 comprises APCI probe 184 positioned with axis 203 approximately aligned with axis 235 of dielectric capillary 52. Sample introduction probe 240 is in positioned to move perpendicular to axis 235 of capillary 52. Multiple solid or liquid phase samples loaded onto sample introduction probe 240 can be moved rapidly across APCI probe 184 exit opening 193 allowing rapid APCI MS analysis of many samples. Sample introduction probe 240 is inserted and removed through port 241 manually or using automated sample handling means APCI source 242 allows rapid exchange of one or more sample introduction probes such as introduction from two to four sides of APCI source 242 The focusing of heated reagent ions and neutral gas through APCI probe 184 exit opening 193 focuses APCI to occur in a limited area along sample introduction probe 240. The localized focusing of APCI allows samples to be closely spaced along sample introduction probe 240 with little or no ionization cross talk between samples. Centerline focusing of heated reagent ions and neutral gas through exit opening 193 allows rapid MS analysis of multiple samples with no carry over between samples. Similar to the APCI source 234 diagrammed in FIG. 10, APCI source 242 can be operated as a sample solution flow APCI source for LC/MS analysis when sample solution is introduced through inlet tube 186 and introduction probe 240 is removed from APCI source 242

Figure 12:
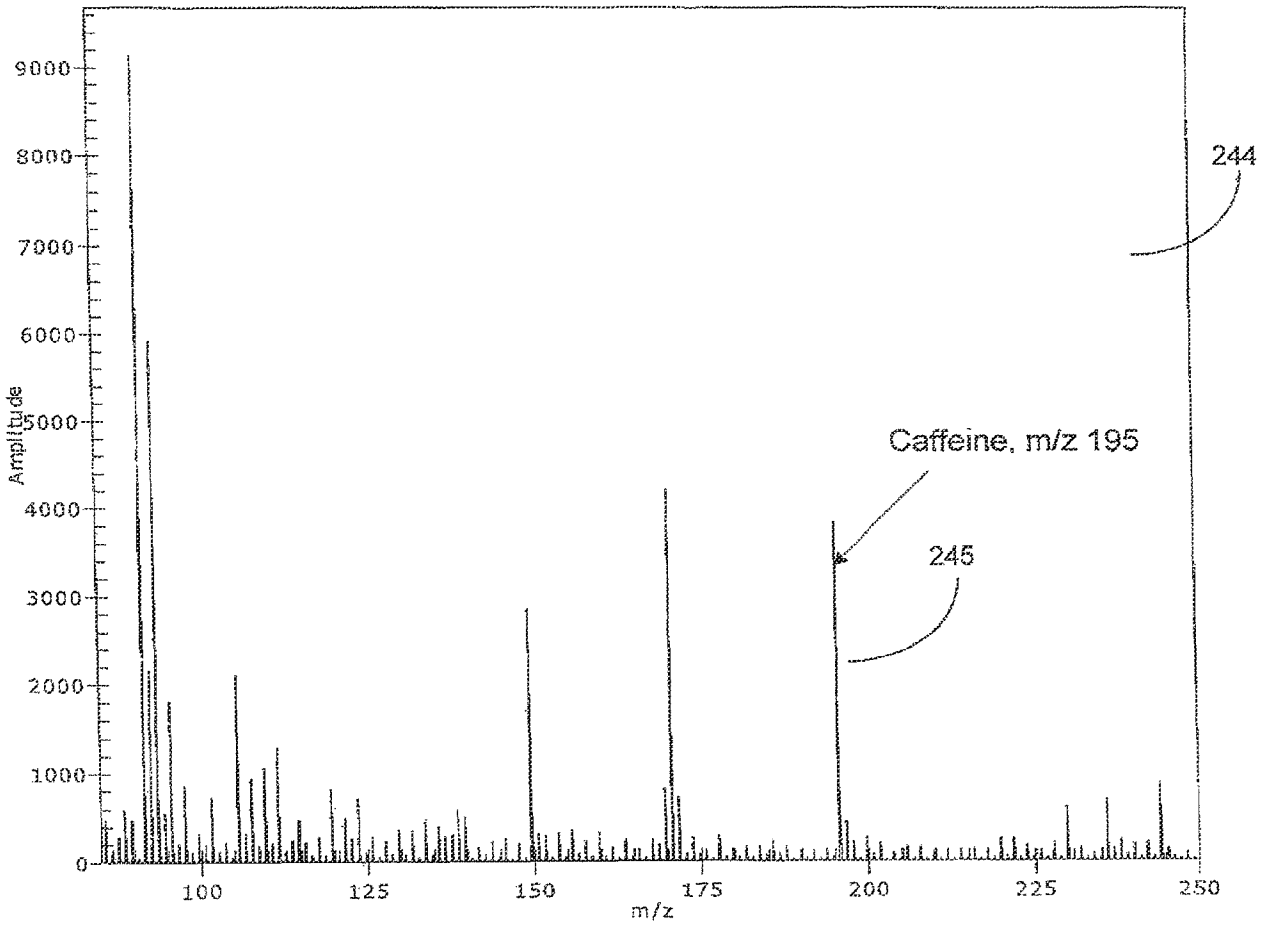
FIG. 12 is a Time-Of-Flight Mass Spectrum acquired from a sample of Caffeine introduced on a solids probe using an APCI source configured similar to that diagrammed in FIG. 11
Figure 13:
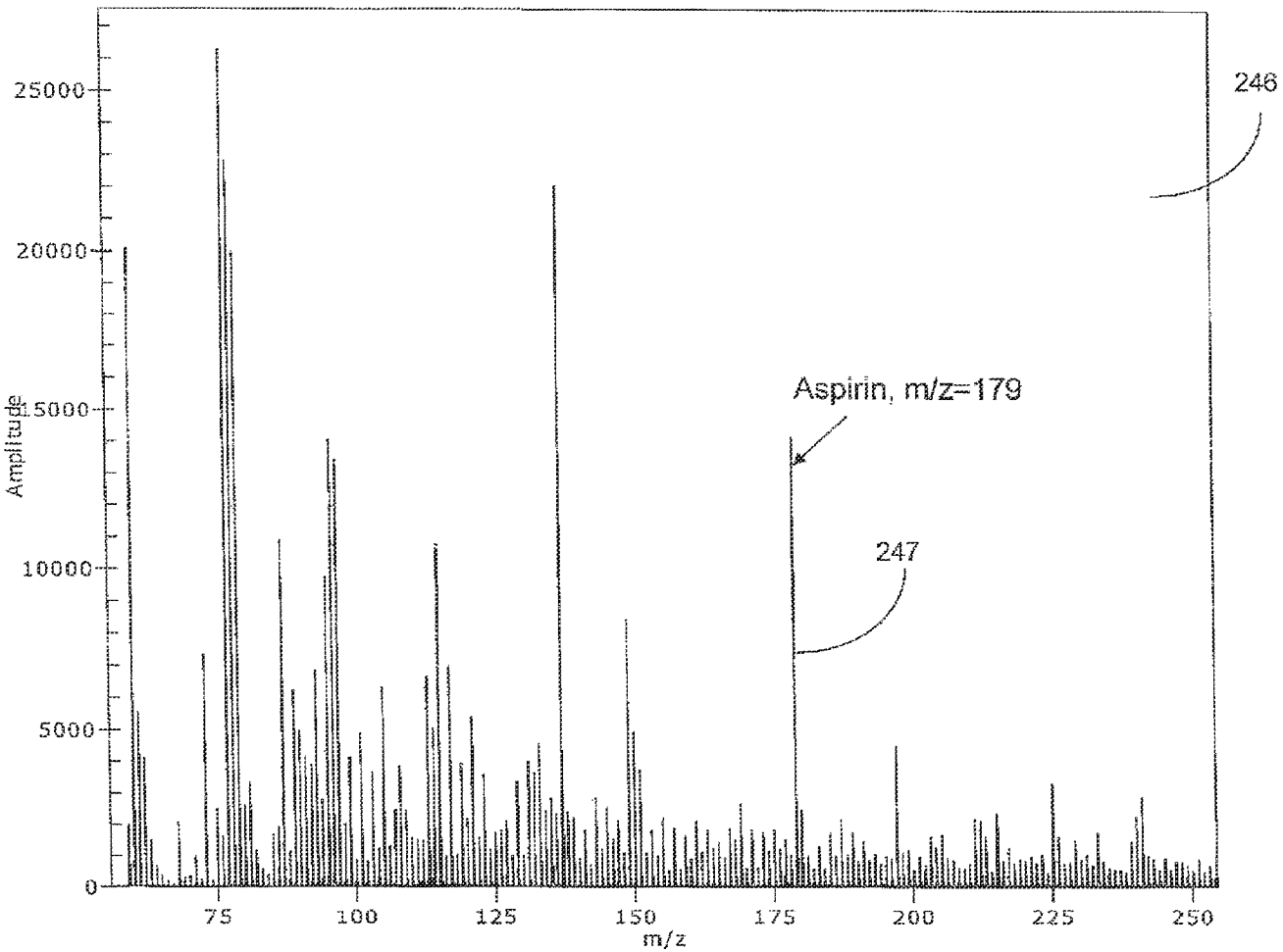
FIG. 13 is a Time-Of-Flight Mass Spectrum acquired from an Aspirin pill introduced on a solids probe using an APCI source configured similar to that diagrammed in FIG. 11.
Figure 14:
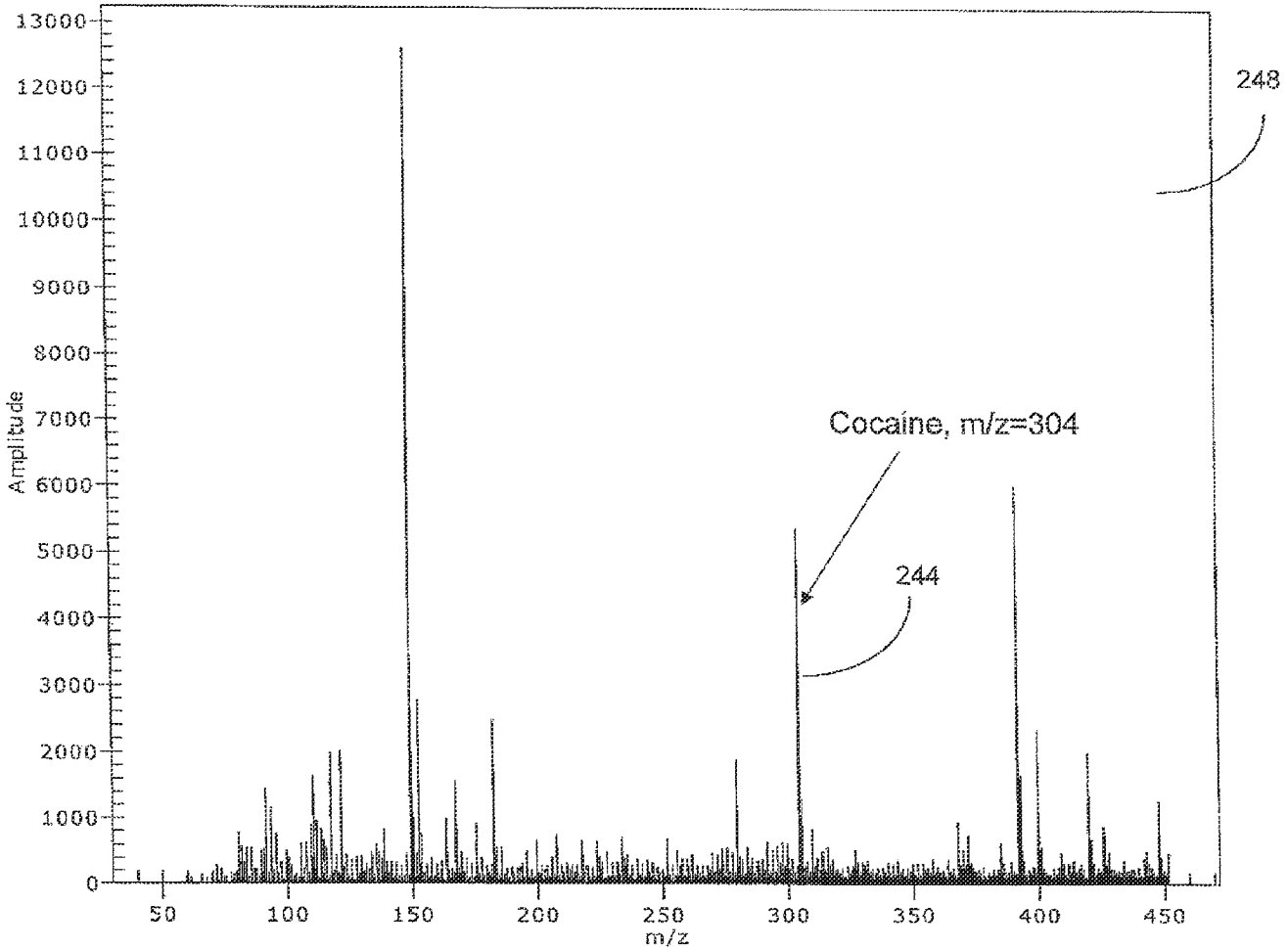
FIG. 14 is a Time-Of-Flight Mass Spectrum (TOF MS) of molecules, including Cocaine, evaporated from a twenty dollar bill introduced into an APCI source configured similar to that diagrammed in FIG. 10.
Figure 15:
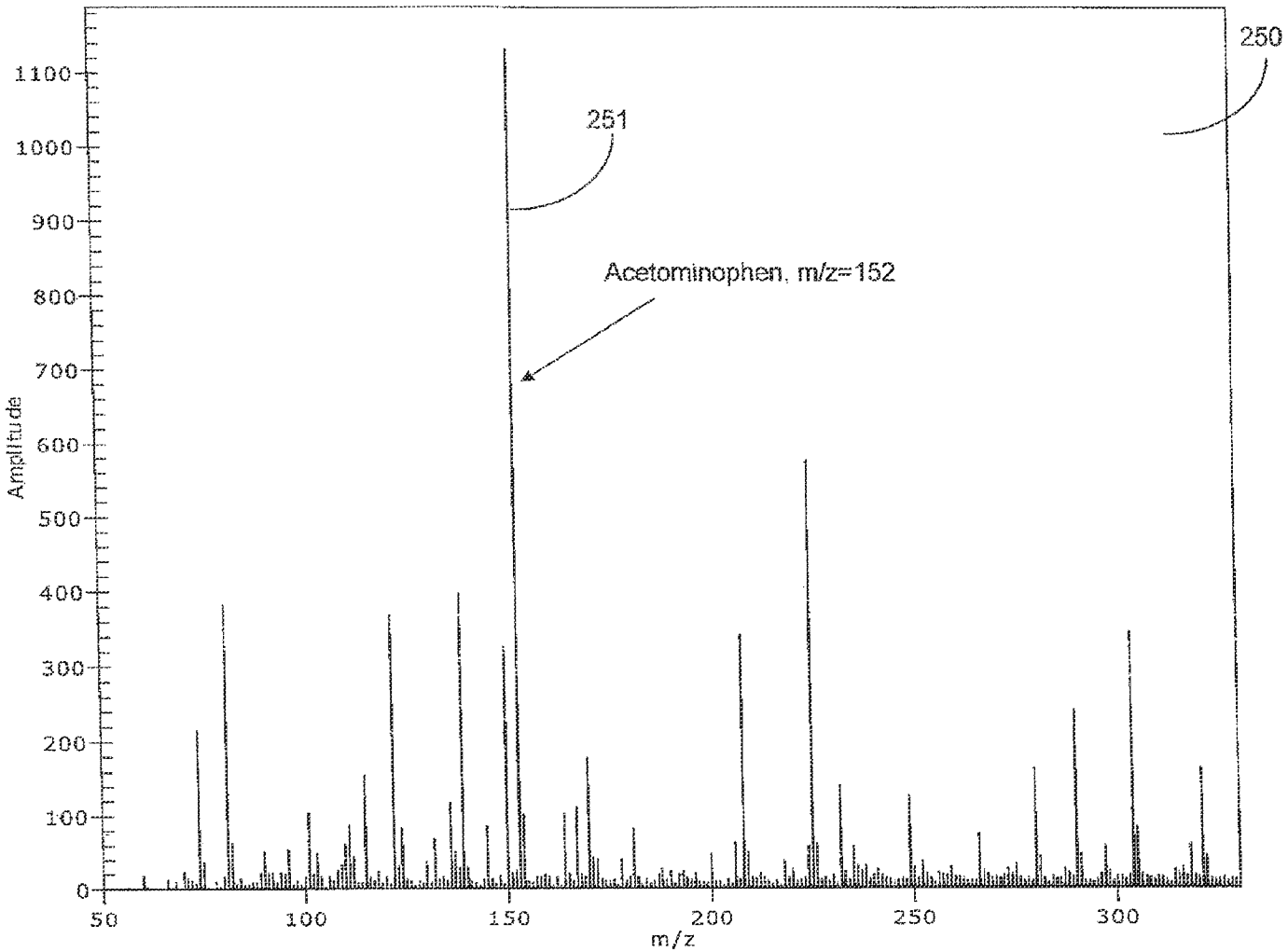
FIG. 15 is a Time-Of-Flight Mass Spectrum acquired from a Tylenol tablet introduced on a solids probe using an APCI source configured similar to that diagrammed in FIG. 11.

FIG. 12 shows Time-Of-Flight mass spectrum 244 of a Caffeine sample acquired using a multiple function APCI source configured similar to APCI source 242 diagrammed in FIG. 11. Positive ion polarity mass spectrum 244 containing peak 245 of protonated Caffeine at mass to charge 195 was acquired from a 20 pM sample of caffeine deposited on a stainless steel sample introduction probe 240. Voltages of +3600V, 0V, 0V, −200V and −1000V were applied to corona needle 194, exit plate 192, sample introduction probe 240, endplate electrode 37 and capillary exit electrode 38 respectively. FIG. 13 shows negative ion polarity mass spectrum 246 of an Aspirin pill loaded onto sample inlet probe 240 and run with an APCI source configured similar to multiple function APCI source 242. Mass spectrum 246 shows peak 247 of protonated Aspirin as well as mass to charge peaks of additional components in the Aspirin pill. Similarly, FIG. 14 shows mass spectrum 248 containing peak 249 of Cocaine acquired by introducing a twenty dollar bill (U.S.) into a multiple function APCI source configured similar to APCI source 242. FIG. 15 shows mass spectrum 250 containing peak 251 of Acetominophen acquired by introducing a Tylenol tablet on sample introduction probe 240 into a multiple function APCI source configured similar to APCI source 242 diagrammed in FIG. 11.

Figure 16:
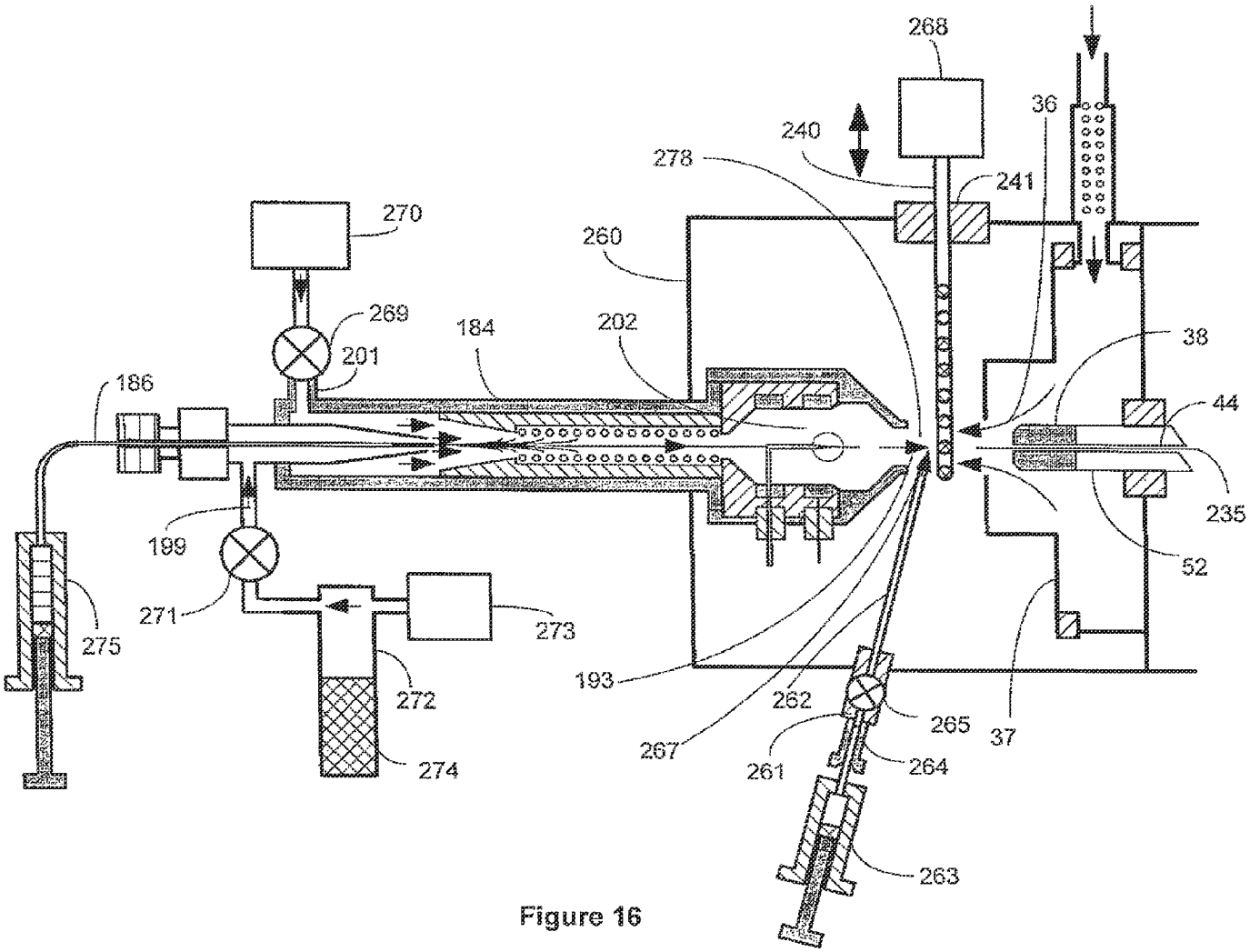
FIG. 16 is a cross section diagram of an alternative embodiment of the invention wherein a multiple function, multiple sample inlet APCI source comprises an APCI inlet probe configured according the invention positioned approximately along the axis of the orifice into vacuum supplying reagent ions to ionize solid or liquid phase samples introduced on an inlet probes or gas phase samples introduced through a separate inlet.

The analytical capability of multiple function APCI source 242 can be expanded by the addition of a gas phase sample introduction probe as shown in the preferred embodiment of the invention diagrammed in FIG. 16. Referring to FIG. 16, multiple function APCI source 260 configured according to the invention comprises solid and liquid phase sample introduction probe 240, gas sample inlet probe 261, APCI probe 184, endplate electrode 37, heated countercurrent drying gas 36 and capillary 52 orifice 44 into vacuum. In multiple function APCI source 260 sample and/or reagent species may be introduced simultaneously or independently through solids or liquid phase sample introduction probe 240, gas sample inlet probe 261, liquid sample tube inlet 186, nebulizer gas inlet 199, or auxiliary gas inlet 201. As described previously, solids or liquid inlet probe 240 may be introduced manually through port 241 or by automated sample handling means 268. Gas samples can be introduced through gas inlet probe 261 into region 278 between APCI probe 184 exit opening 193 and endplate 37 with or without solids or liquid sample introduction probe 240 positioned in region 278. Gas samples may be introduced into gas inlet port 261 using syringe 263, manually or mechanically driven, inserted into connector 264 or by using other gas supply devices. Gas flow through inlet tube 262 can be turned on or off using valve 265. Sample or reagent gas may be introduced through gas inlet probe 261. Sample gas is ionized by reagent ions exiting APCI probe 184. Reagent gas introduced through gas inlet probe 261 and ionized by different species reagent ions exiting from APCI probe 184 may be introduced to enhance chemical ionization of specific samples loaded on solids or liquid sample introduction probe 240. Alternatively, sample or reagent gas species can be introduced through nebulization gas inlet 199 or auxiliary gas inlet 201. Liquid reservoir 272 with reagent liquid 274 can be configured upstream of nebulization gas inlet 199. Nebulization gas and auxiliary gas are supplied from pressure sources 273 and 270 respectively with gas flow controlled though valves and/or pressure regulators 271 and 269 respectively. Sample or reagent solution flow can be introduced through inlet tube 186 from syringe 275 operated manually or mechanically. Alternatively, liquid sample may be introduced through inlet tube 186 from a Liquid or Ion Chromatography system. Reagent ions generated in vapor flow channel 202 of APCI probe 184 ionize gas, liquid or solid samples introduced into region 278. Resulting APCI generated sample ions are directed into capillary 52 orifice 44 by the electric fields in region 278. A portion of the ions passing through orifice 44 into vacuum are mass to charge analyzed. Sample ions generated in APCI probe 184 can be selected to react with sample species introduced in region 278 when specific chemical ionization, charge reduction or chemical reactions are desired in a chemical analysis.

Figure 17:
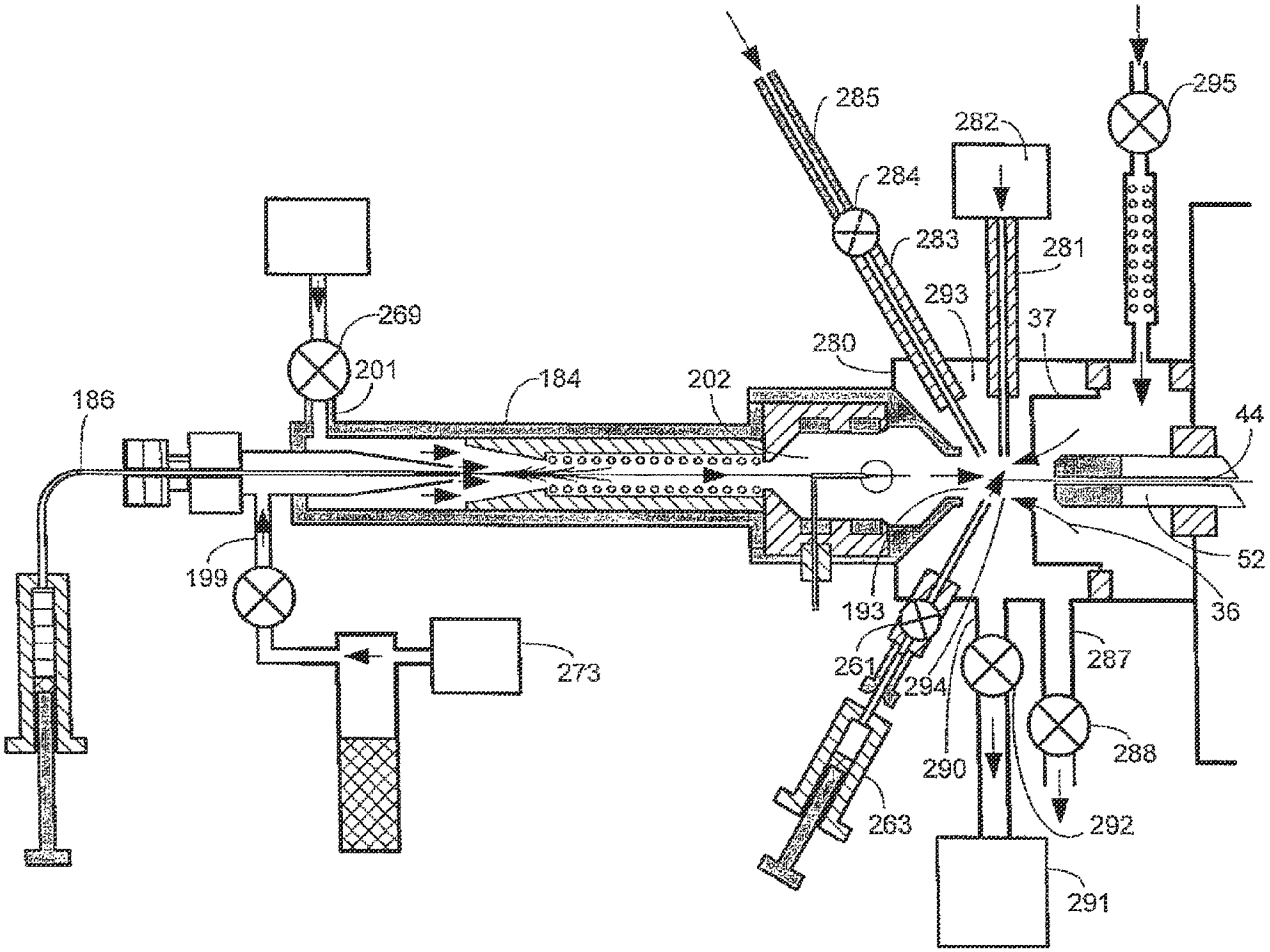
FIG. 17 is a cross section diagram of an alternative embodiment of the invention wherein a multiple function, multiple sample inlet APCI source comprises an APCI inlet probe configured according the invention positioned approximately along the axis of the orifice into vacuum supplying reagent ions to ionize liquid or gas phase samples introduced through separate inlet systems.

An alternative embodiment of the invention is diagrammed in FIG. 17 wherein multiple gas sample inlet ports are configured in APCI source 280. APCI source 280 comprises heated gas chromatography inlet 281, heated ambient gas sampling inlet 283, gas sample inlet port 261, APCI probe 184 configured according to the invention, gas pumping port 290, gas vent port 287, endplate electrode 37, dielectric capillary tube 52 and heated counter current drying gas 36. The volume of APCI source chamber 293 is reduced to minimize dispersion of introduced gas samples. Gas samples may be introduced into APCI region 294 from Gas Chromatograph 282 through heated inlet 281. Gas samples can be introduced through gas inlet port 261 using a manually or mechanically operated syringe 263 or other gas introduction device. Gas sample introduced into APCI source chamber 293 from Gas Chromatograph 282, syringe 263, auxiliary gas source 274 or from nebulization gas source 273 are delivered to region 294 by higher upstream gas pressure. Gas sample is introduced from sources or reaction vessels at or near ambient pressure through heated sampling tube 285 or through auxiliary gas inlet 201 configured for ambient gas sampling. Gas is sampled from ambient pressure sources into APCI source chamber 293 by reducing the pressure in APCI chamber 293. Gas pressure is reduced in sealed APCI source chamber 293 by pumping gas through gas pumping port 290 using vacuum pump, diaphragm pump or fan 291. Valve 292 regulates the pumping speed applied to APCI source chamber 293 during ambient gas sampling. The flow late of gas sampling through heated sampling tube 285 or auxiliary gas inlet port 201 is regulated by the sampling tube 285 inner diameter and length, sampled gas temperature, gas flow regulating valves 269 and/or 284 respectively and the pressure maintained in APCI source chamber 293. When gas is being sampled from ambient pressure gas sources, the gas chromatography injector valve is closed or the gas chromatography inlet removed and vent valve 288 is closed. Reagent nebulizing gas, auxiliary gas and/or reagent liquid is introduced through nebulizing gas inlet 199, auxiliary gas inlet 201 and/or tube inlet 186 respectively for all modes of APCI source operation. Valve 295 regulates the flow of heated counter current gas into APCI source chamber 293 during all operating modes. Countercurrent gas flow 36 prevents contaminant neutral molecules that have not been ionized from entering vacuum during all operating modes. The flow rate of countercurrent gas is typically set equal to or greater than the gas flow rate through capillary 52 orifice 44 into vacuum. APCI generated reagent or sample ions exit APCI probe 184 through vapor flow channel exit opening 193 into reduced volume region 294 in APCI source chamber 293. Gas samples introduced through gas inlets 261, 281 or 283 individually or simultaneously are ionized by Atmospheric Pressure Chemical Ionization with reagent or sample ions exiting APCI probe 184. Resulting gas sample ions are directed into orifice 44 of capillary 52 by the applied electric fields in region 294. A portion of the ions swept into vacuum through orifice 44 are mass to charge analyzed. APCI source 280 configured according to the invention may, in addition, comprise solids or liquids probe 240 describe above.

Figure 18:
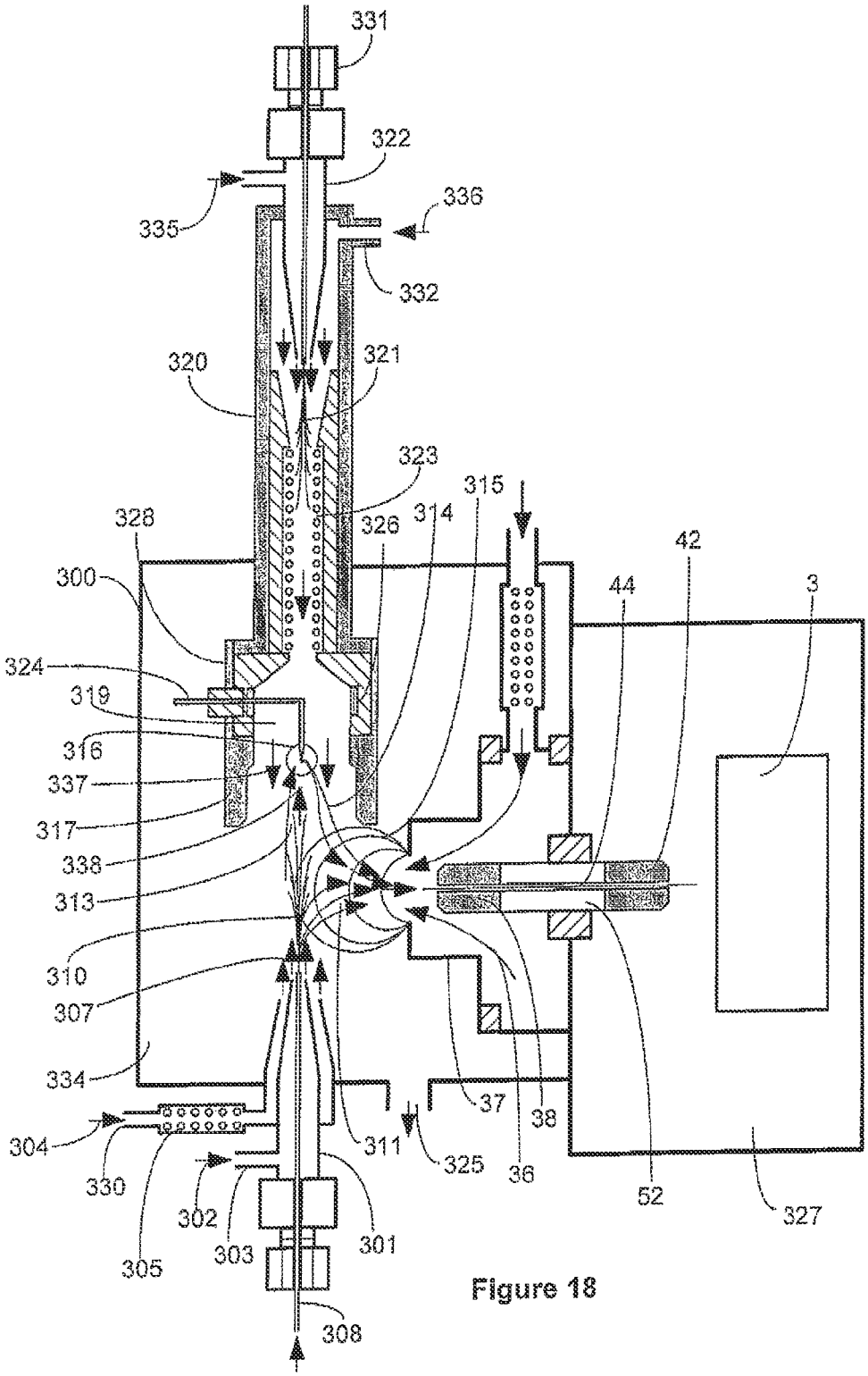
FIG. 18 is a cross section diagram of an alternative embodiment of the invention wherein a combination Electrospray and APCI source comprises a shielded APCI inlet probe configured according to the invention positioned approximately perpendicular to the sampling orifice axis and approximately aligned with the Electrospray inlet probe axis.

Atmospheric Pressure Chemical Ionization sources interfaced to mass spectrometers provide a highly useful and robust analytical tool. However, APCI has limitations with respect to mass range and molecule types that can be ionized by the technique. APCI can be used to ionize molecular species that are not thermally labile, less polar and that can accept a cation in the gas phase in positive ion polarity mode or release a cation or accept an anion in negative ion polarity operating mode Generally, APCI is limited to ionizing non polar or slightly polar molecules with molecular weights below 1000 amu. Electrospray (ES) ionization is a powerful ionization technique that allows ionization of a broad range of polar and even non polar compounds directly from solution with essentially no limit on molecular weight range or compound thermal lability. For many analytical applications, APCI and Electrospray ionization with mass spectrometric analysis are complementary techniques. When a sample is run through single function APCI and Electrospray ion sources, two separate analysis are required expending additional time, resources and sample. Consequently, for selected analytical applications, a combination ion source that includes Electrospray ionization and APCI applied to a single sample solution input provides improved analytical performance, convenience and efficiency and increased speed of analysis. An alternative embodiment of the invention is diagrammed in FIG. 18 wherein Electrospray and APCI ionization are combined in an atmospheric pressure ion source, configured according to the invention and interfaced to a mass to charge analyzer.

Combination Electrospray and APCI source 300 configured according to the invention comprises Electrospray inlet probe 301, APCI probe 320, endplate electrode 37, dielectric capillary 52, vacuum system 327 and mass to charge analyzer 3 Electrospray inlet probe 301 is configured with sample solution inlet tube 308, nebulizer gas inlet 303 and heated sheath gas inlet 330 with heater 305 APCI probe 320 is configured according to the invention with nebulizer assembly 322, vaporizer or heater 323 and vapor flow channel assembly 328. In the embodiment of the invention diagrammed in FIG. 18 the axis of Electrospray inlet probe 301 and centerline 341 of APCI probe 320 are approximately aligned. The exit end of Electrospray inlet probe 301 faces the exit end of APCI probe 320 so that during ion source operation a portion 313 of Electrospray plume 310 enters the exit end of vapor flow channel 340. Portion 313 of Electrospray plume 310 that enters vapor flow channel 340 is evaporated and ionized through APCI in region 338 Cylindrical electrode 326, configured in vapor flow channel 340, is electrically connected to corona discharge needle 324. Grounded electrode 317 serves as the corona discharge counter electrode and partially shields APCI source chamber 334 from the corona discharge electric field. Corona discharge 316 is turned on by applying the appropriate voltage to corona discharge needle 324. Electrospray inlet probe 301 is operated at ground potential. Sample solution introduced through inlet tube 308 of Electrospray inlet probe 301 forms pneumatically nebulized and droplet spray 310 at Electrospray inlet probe exit end 307. At higher sample solution flow rates, heated sheath gas flow can be turned on to aid in evaporation of droplet spray 310. Heated sheath gas 304 enters APCI chamber 334 concentrically around exit end 307 of ES inlet probe 301. In all combination ES and APCI source 300 operating modes, a voltage differential is applied between endplate electrode 37 and capillary entrance electrode 38 to maintain electric field 315 that focuses Electrospray and APCI generated ions into dielectric capillary 52 orifice 44. Combination ES and APCI ion source 300 can be run in Electrospray only, APCI only and combined Electrospray and APCI operating modes Positive ion polarity Electrospray ionization is run by applying negative kilovolt potentials to endplate electrode 37 and capillary entrance electrode 38. Positive polarity charged droplets are produced in nebulized Electrospray plume 310. As the droplets evaporate in spray plume 310, Electrospray ions 311 are generated and focused by electric field 315 into capillary orifice 44 moving against heated counter current drying gas 36. Negative polarity Electrospray ions are produced by applying positive polarity kilovolt potentials to endplate electrode 37 and capillary entrance electrode 38. For example −5 KV and −5.5 KV to 6.0 KV potentials are applied to endplate electrode 37 and capillary entrance electrode 38 respectively for positive ion polarity Electrospray operation. Voltage polarities are reversed for negative ion polarity Electrospray operation. Positive polarity ions entering capillary orifice 44 at minus kilovolt potentials are driven by the neutral gas flow expanding into vacuum through orifice 44 and the ions exit capillary 52 at the potential applied to capillary exit electrode 42. The capability of dielectric capillary 52 to change potential energy of ions traversing the length of orifice 44 is described above and in U.S. Pat. No. 4,542,293. When Electrospray only operation is desired, kilovolt potentials are applied to endplate electrode 37 and capillary entrance electrode 38 as described above with corona discharge 316 turned off. If required for higher sample liquid flow rates, nebulizer gas flow 335 or auxiliary gas flow 336 is turned on and heated as it flows through APCI probe 320. Heated gas flow 337 exiting APCI probe 320 through vapor flow channel 340, aids in evaporating charged droplets in Electrospray plume 310. The improved charged droplet evaporation rate increases the efficiency of Electrospray ion production within the region of ion focusing electric field 315.

APCI only operation is run by reducing the voltages applied to endplate electrode 37 and capillary entrance electrode 38 below the level required for production of single polarity highly charged Electrospray droplets When reduced voltages are applied to endplate electrode 37 and capillary entrance electrode 38, net neutral polarity droplet spray is produced by pneumatic nebulization of sample solution flowing through inlet tube 308. Voltage is applied to corona discharge needle 324 to maintain corona discharge 316 Net neutral evaporating droplet spray 313 enters vapor flow channel 340 moving against heated reagent gas and ion flow 337 Evaporated sample spray 313 penetrates into vapor flow channel 340 a sufficient distance to effect Atmospheric Pressure Chemical Ionization in region 338 driven by corona discharge 316. Reagent ion species are generated from evaporated solvent molecules from the sample solution or from heated reagent gas or vapor generated in APCI probe 320. As described in earlier sections, reagent ion species can be generated in APCI probe 320 from one or a combination of nebulizer gas flow 335, auxiliary gas flow 336 or reagent solution introduced through inlet tube 331 with pneumatic nebulization to form spray 321. Heated vapor flow 337 moves APCI generated sample ions out of vapor flow channel 340. Focusing electric field 315 penetrating into vapor flow channel 340 directs APCI generated sample ions 314 toward capillary orifice 44. Optimal APCI only operation can be achieved for different sample solution flow rates introduced through Electrospray inlet probe 301 by tuning APCI gas flow rate 337, APCI probe reagent gas temperature and corona discharge needle current or voltage. Alternatively APCI only operating mode can be run by introducing sample solution through inlet tube 331 in APCI probe 320 with APCI probe 320 operated as described in previous sections. In this APCI only operating mode, no sample solution is introduced through ES inlet probe 301 but heated sheath gas may be turned on to help APCI generated ions move towards capillary orifice 44.

Combination Electrospray and APCI operating mode is run by applying kilovolt potentials to endplate electrode 37 and capillary entrance electrode 38 as described above for Electrospray only operating mode. In combination ES and APCI operating mode, corona discharge 316 and heated gas flow 337 remains on during Electrospray operation. Electrospray ions 311 formed from evaporating charged droplets are directed toward capillary orifice 44 by electric fields 315. Neutral sample gas 313 produced from evaporating charged droplets penetrates into vapor flow channel 340. Atmospheric Pressure Chemical Ionization of gas phase sample molecules occurs in region 338 as described above for APCI only operating mode. Heated gas or vapor flow 337 and the electric field from corona discharge 316 move APCI generated ions out of vapor flow channel 340. Focusing electric field 315 penetrating into vapor flow channel 340 directs APCI generated sample ions 314 toward capillary orifice 44 against heated counter current drying gas flow 36. A mixture of Electrospray and APCI generated sample ions are swept through capillary 52 orifice 44 into vacuum by the expanding neutral gas flow where they are mass to charge analyzed by mass to charge analyzer 3 When sample solution is introduced through Electrospray inlet probe 301, fast switching between ES only, APCI only and combination ES and APCI operating modes can be achieved by rapidly changing voltage values applied to corona discharge needle 324, endplate electrode 37 and capillary entrance electrode 38 In all operating modes, excess gas and vapor flowing into combination ES and APCI source 300 exits through vent 325.

Figure 19:
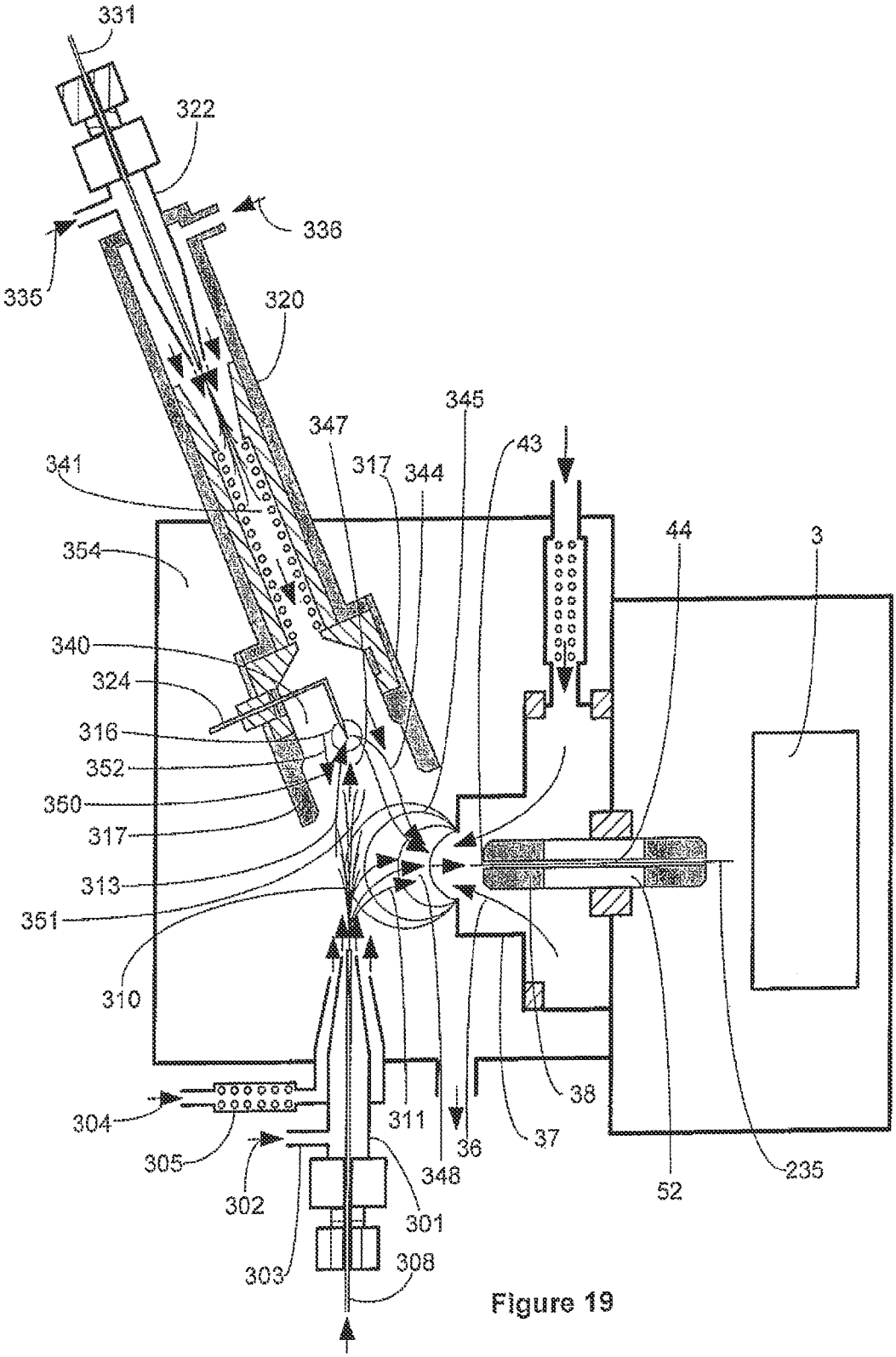
FIG. 19 is a cross section diagram of an alternative embodiment of the invention wherein a combination Electrospray and APCI source comprises a shielded APCI inlet probe configured according to the invention positioned at an angle to the sampling orifice axis and at an angle to the Electrospray inlet probe axis

An alternative embodiment of the invention is diagrammed in FIG. 19 wherein combination ES and APCI source 354 comprises the same elements as combination ES and APCI source 300 described above. In combination ES and APCI source 354, APCI probe 320 is positioned with its centerline 341 passing through but angled to the projection of axis or centerline 235 of capillary 52. Electrospray inlet probe 301 is positioned with its extended axis approximately passing through centerline 341 of APCI probe 320 near corona 316. Sample solution introduced through inlet tube 308 of Electrospray inlet probe 301 forms nebulized and Electrospray plume 310. In Electrospray and combination ES and APCI operating modes, Electrospray charged droplets and ions 311 formed from evaporating Electrosprayed droplets are directed toward entrance 43 of capillary 52 orifice 44 by electric field 345. Electrosprayed charged droplets moving with electric field 395 against heated counter current drying gas 36 evaporate and produce ions that are focused by Electric field 395 toward entrance 43 of capillary orifice 44. A portion 313 of spray 310 enters exit end 351 of vapor flow channel 340 due to the momentum of nebulized spray plume 310. Droplets contained in portion 313 of spray plume 310 entering vapor flow channel 340 move against heated gas and reagent ion flow 352. APCI probe 320 heated gas or vapor 352 aids in evaporating droplets contained in portion 313 of spray 310 forming sample and solvent vapor in region 350 of vapor flow channel 340. As described for combination ES and APCI source 300 embodiment diagrammed in FIG. 18, corona discharge 316 is maintained during APCI only and ES and APCI combination mode operation Corona discharge 316 is formed by applying voltage to corona discharge needle 324 while maintaining cylindrical shielding electrode 317 at ground potential. Alternatively, voltage can be applied to cylindrical electrode 317 where a non dielectric or conductive capillary or orifice into vacuum is configured in combination ES and APCI ion source 354.

APCI generated analyte ions 344 formed in vapor flow channel 340 in region 347 are moved out of vapor flow channel 340 by heated gas and reagent ion flow 352 and the electric field from corona discharge 316. Exiting analyte ions are directed toward entrance 43 of capillary orifice 44 by electric field 345 formed by the voltages applied to endplate electrode 37 and capillary entrance electrode 38 Due to the angle of APCI probe 320 axis 341 relative to the axis of Electrospray inlet probe 301 and capillary centerline 235, APCI generated sample and reagent ions 344 exit vapor flow channel 340 with a trajectory that is angled to and not directly opposing incoming spray plume 313. Angled APCI probe 320 provides a different flow path and angle for entering sample spray plume and vapor 313 and exiting sample ions, reagent ions and vapor. Although some overlap may occur for higher sample liquid flow rates establishing different sample vapor entrance and exit angles and trajectories reduces the interaction of APCI generated sample ions with partially evaporated neutral droplets of the incoming sample spray plume, Such interaction can neutralize APCI generated sample ions reducing sensitivity. The angled position of APCI probe 320 also provides a more optimized performance when running APCI only mode with sample solution introduced through sample inlet tube 331 in APCI probe 320. Positioning APCI probe 320 at an angle to capillary centerline 235 and the centerline of ES inlet probe 301 improves the performance of combination ES and APCI source 354 over a wide range of sample solution flow rates. The relative positions of APCI probe 320, ES inlet probe 301 and capillary entrance 43 are adjustable to optimize performance for different sample solution flow rates and compositions. Switching between ES only, APCI only and combination ES and APCI operating modes is conducted by changing voltages applied to corona discharge needle 324, endplate electrode 37 and capillary entrance electrode 38 as described for combination ES and APCI source embodiment 300. Counter current drying gas 36 flow rate and temperature, sheath gas 304 flow rate and temperature and APCI probe 320 gas or vapor flow rate and temperature can also be changed to optimize performance for each operating mode. In addition, the flow rate and composition of a reagent solution introduced through inlet tube 331 of APCI probe 320 can be changed or turned on or off to optimize performance when switching between different operating modes of combination ES and APCI source 354.

Figure 20:
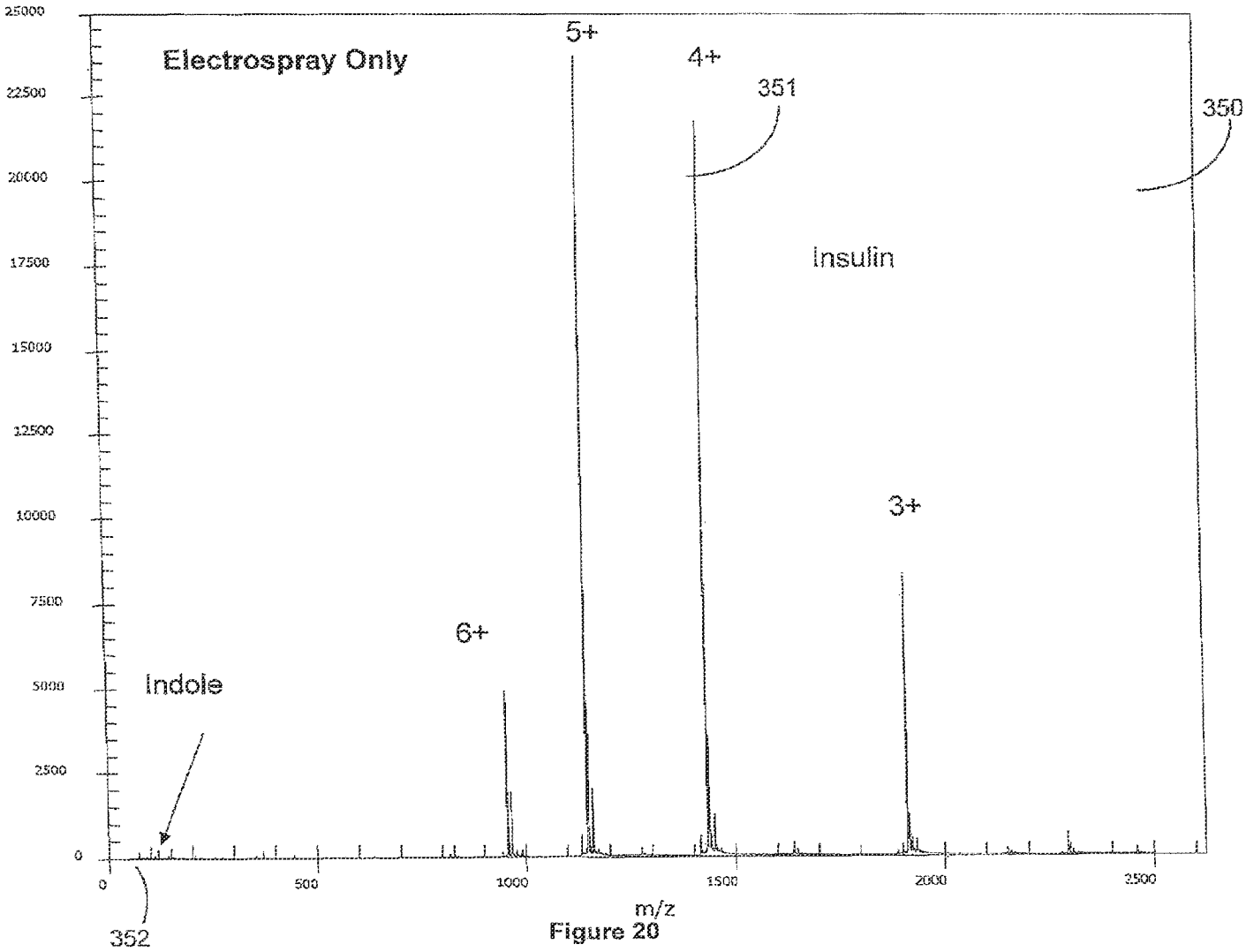
FIG. 20 is a TOF MS spectrum of a sample solution mixture containing insulin and indole using the combination ES and APCI source configured similar to that diagrammed in FIG. 18 operated in ES only mode.
Figure 21:
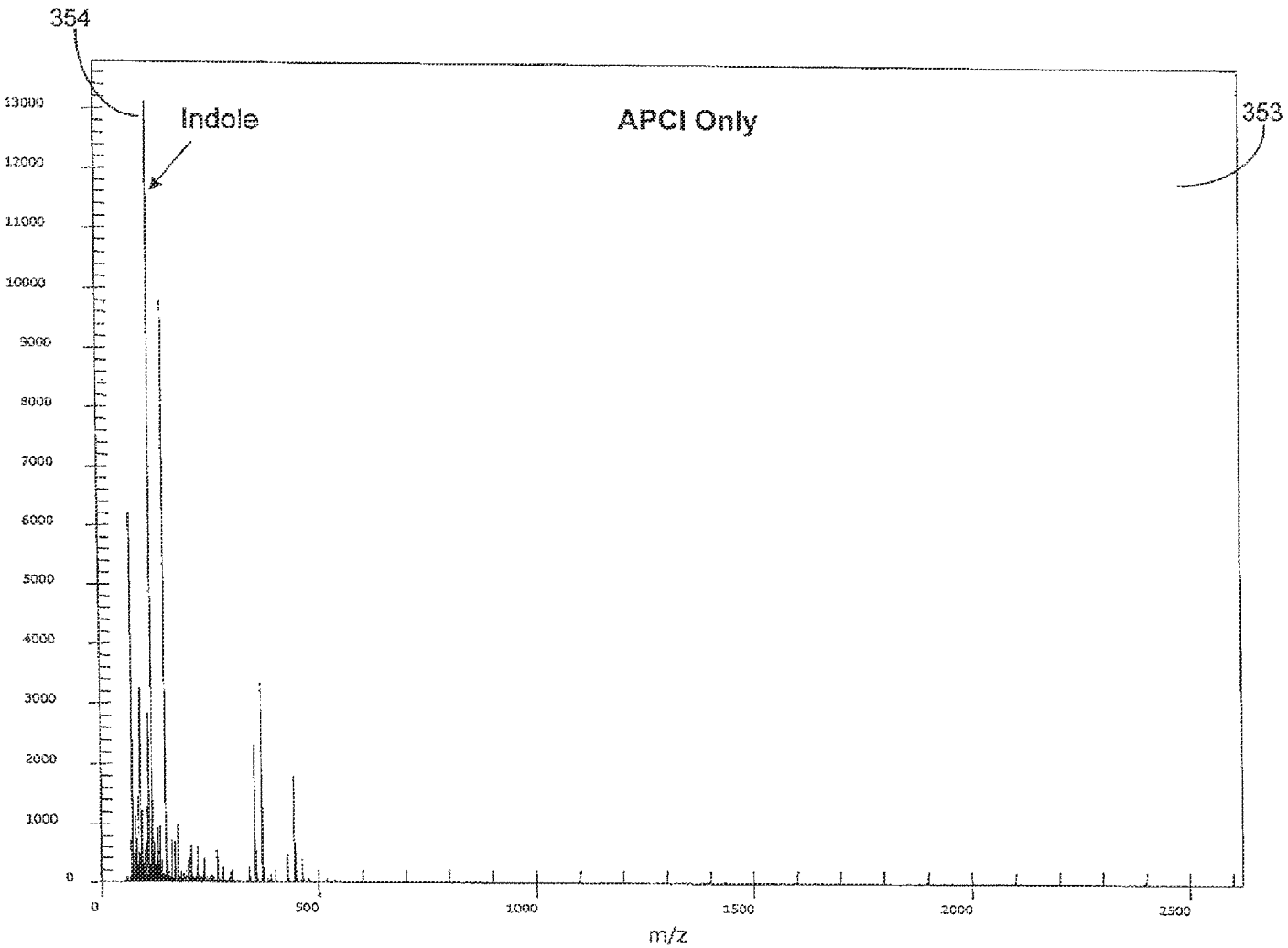
FIG. 21 is a TOF MS spectrum of a sample solution mixture containing insulin and indole using the combination ES and APCI source configured similar to that diagrammed in FIG. 18 operated in APCI only mode.

Mass spectrum 350 in FIG. 20 was acquitted running positive ion polarity Electrospray only mode using a combination ES and APCI source configured similar to combination ES and APCI source 354 diagrammed in FIG. 19. A sample solution mixture of 20 pM/μl of Indole and 100 pM/μl Bovine Insulin in 1:1 Water/Methanol with 0.1% Formic Acid was introduced through inlet tube 308 of Electrospray inlet probe 301. In positive ion polarity Electrospray only mode, ES inlet probe 301 and corona discharge needle 324 were operated at ground potential with negative kilovolt potentials applied to endplate electrode 37 and capillary entrance electrode 38 A series of mass spectra peaks 351 of multiply charged ions of Bovine insulin, characteristic of Electrospray ionization of high molecular weight compounds, are contained in mass spectrum 350. No multiply charged ion signal of thermally labile bovine insulin would be produced by APCI. A low intensity peak 352 of Indole is observed in Electrospray only mass spectrum 350 as expected. Mass spectrum 353 in FIG. 21 was acquired running positive polarity APCI only mode using the same combination ES and APCI source while introducing the same sample solution as was described above. The operating mode of the combination ES and APCI source, configured similar to combination ES and APCI source 354, was switched from ES only to APCI only operating mode with the same sample solution flow to prior to acquiring TOF mass spectrum 353. In APCI only operating mode, voltage was applied to corona discharge needle 324 to maintain corona discharge 316 and the voltages applied to endplate electrode 37 and capillary entrance electrode 38 were lowered below the values required for Electrospray ionization. Mass spectrum peak 354 of APCI generated Indole ions is contained in mass spectrum 353 with significantly higher intensity than was observed in the mass spectrum acquired in ES only mode. Mass spectra 350 and 353 demonstrate the expanded analytical utility of combination ES an APCI source 354 configured according to the invention. The invention allows rapid switching between optimized ES only, APCI only and combination ES and APCI mode operation with sample solution introduction through Electrospray inlet probe 301. Alternatively, APCI only operation can be conducted with sample solution flow introduced through inlet tube 331 of APCI probe 320. Reagent solution for APCI ionization can be introduced through inlet tube 331 of APCI probe 320 or through Electrospray inlet probe 301 as part of the sample solution. Reagent gas for APCI ionization can be introduced through nebulizing gas flow 335 or auxiliary gas flow 336 in APCI probe 320. All gas, vapor and liquid flow rates and temperatures, voltages and corona discharge current can be adjusted to achieve optimal performance in all operating modes. APCI probe 320 and Electrospray inlet probe 301 positions can be adjusted to achieve optimal performance in all operating modes and for different sample solution flow rates and compositions. Table 3 shows the relative performance of combination ES and APCI source 354 configured according to the invention compared with standard single function ES and APCI sources. The sample solution was a mixture of 1 pg/μl of Reserpine and 10 pg/μl of Indole in 1:1 Water/Methanol with 0.1% Acetic Acid introduced at the sample solution flow rates listed in Table 3.

TABLE 3

| Flow, | Combination ES and APCI Source | | | | | | Standard Sources | | | |
|---|---|---|---|---|---|---|---|---|---|---|
| | ES + APCI | | ES | | APCI | | ES | | APCI | |
| μL/min | Indole | Reserpine | Indole | Reserpine | Indole | Reserpine | Indole | Reserpine | Indole | Reserpine |
| 10 | 5000 | 870 | 1483 | 869 | 6781 | 53 | 3.9K | 10.5K | 8.5K | 277 |
| 20 | 7586 | 1871 | 2611 | 3117 | 12.7K | 78 | 16.1K | 3.8K | 15.9K | 511 |
| 100 | 5914 | 3497 | 5627 | 3629 | 18K | 320 | 12K | 3.8K | 43K | 1050 |
| 200 | 4039 | 2941 | 4127 | 2936 | 7.1K | 385 | 8.5K | 3.5K | 50K | 1337 |

Figure 22:
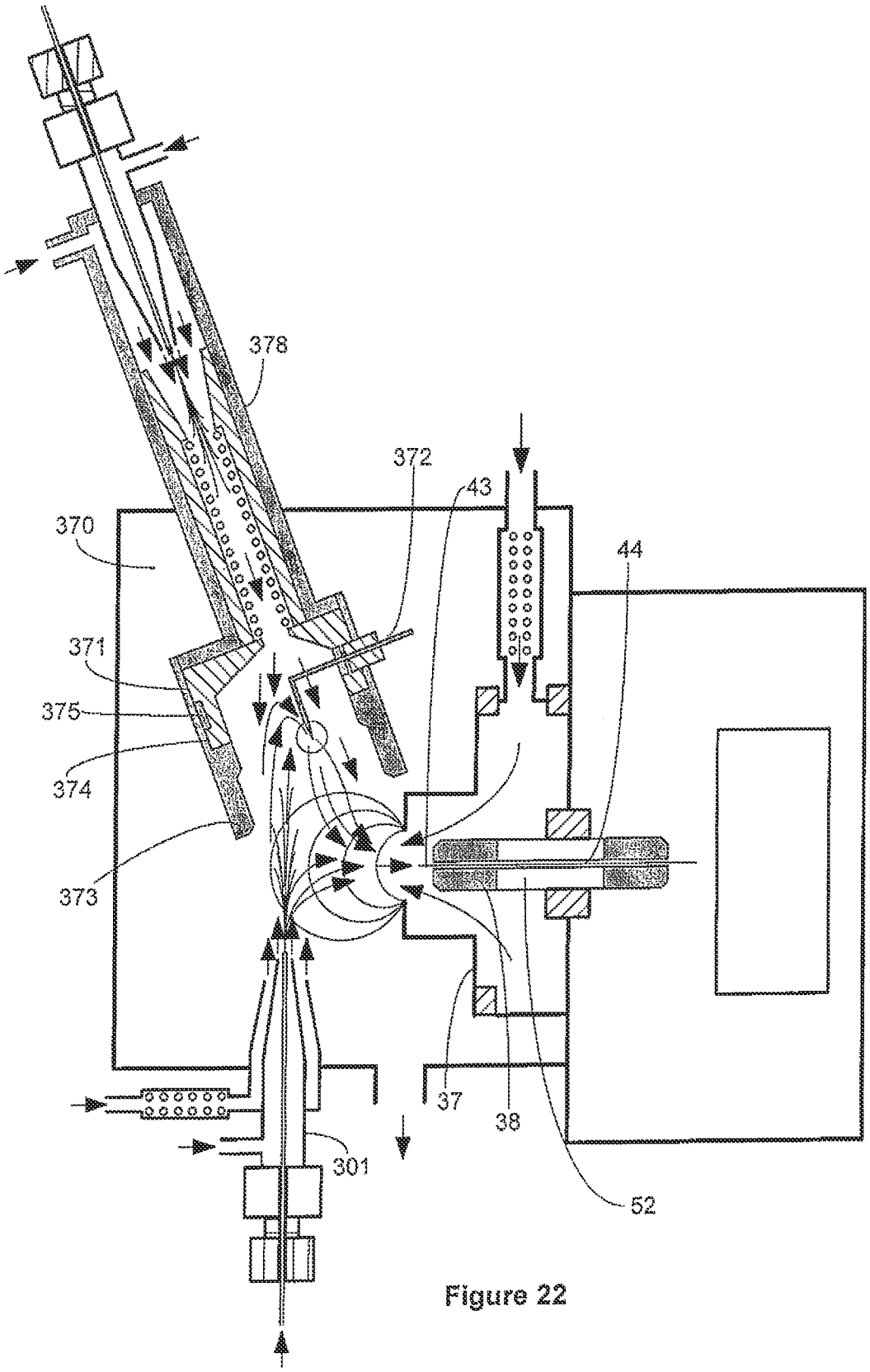
FIG. 22 is a cross section diagram of an alternative embodiment of the invention wherein a combination Electrospray and APCI source comprises a shielded APCI inlet probe configured according to the invention with an expanded vapor flow channel geometry and positioned at an angle to the sampling orifice axis and at an angle to the Electrospray inlet probe axis.
Figure 23:
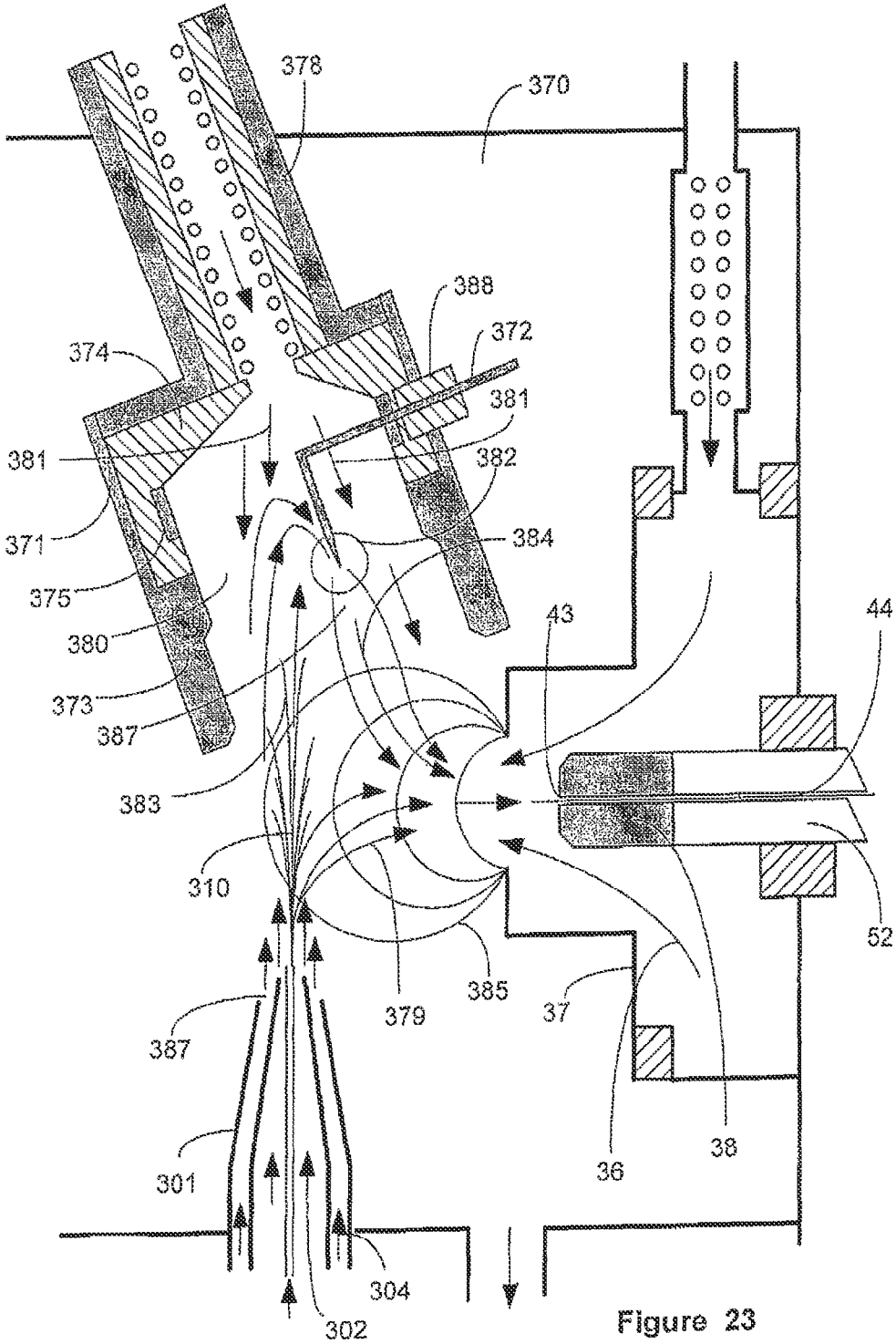
FIG. 23 is a zoomed in view of the Electrospray and APCI region of the combination ES and APCI source diagrammed in FIG. 22

An alternate embodiment of the invention is diagrammed in FIGS. 22 and 23 wherein combination ES and APCI ion source 370 is configured similar to combination ES and APCI ion source 354 but with a modified vapor flow channel assembly 371 configured according to the invention. FIG. 23 is a zoomed in view of vapor flow channel assembly 371, Electrospray inlet probe 301 exit tip 387 and entrance 43 of capillary orifice 44. Similar to the elongated vapor flow channel configuration diagrammed in FIG. 6B, vapor flow channel 380 is elongated to further separate the trajectory of entering droplet and vapor spray plume 383 from the trajectory of exiting APCI generated sample and reagent ions 384 in vapor flow channel 380. The geometry of vapor flow channel assembly 371 allows deeper penetration of entering evaporating droplet and vapor spray plume 383 against APCI probe 378 heated gas and vapor flow 381. This deeper plume 383 penetration provides efficient droplet evaporation even at higher sample liquid flow rates Vapor flow channel assembly 371 comprises surrounding electrode 375 electrically connected to corona discharge needle 372, partially shielding counter electrode 373 and insulators 374 and 388. Corona discharge 382 is maintained by applying voltage to corona discharge needle 372 with shielding counter electrode 373 operated at ground or other optimized voltage value. As described for the embodiments of the invention diagrammed in FIGS. 18 and 19, APCI generated sample and reagent ions formed in vapor flow channel 380 region 387 are directed toward entrance 43 of capillary orifice 44 by a combination of vapor or gas flow 381 exiting vapor flow channel, corona discharge 382 electric field and electric field 385 formed by the voltages applied to endplate electrode 37 and capillary entrance electrode 38 The further separation of Electrospray generated ions 379, gas droplet and vapor flow 383 and APCI generated ion 384 trajectories that is provided by the configuration of elements in combination ES and APCI source 370, minimizes charge neutralization of ES and APCI generated ions and minimized ion interaction with evaporating droplets that can lead to reduction in sample ion signal intensity in mass to charge analysis. The operation of ES only, APCI only and combination ES and APCI mode operation for combination ES and APCI source 370 is similar to that described for combination ES and APCI source embodiments 300 and 354. The design and operation of Combination ES and APCI source 370 allows adjustment of all variables including heated gas or vapor 381 flow rates, composition and temperatures, sheath gas 304 flow rate and temperature, counter current drying gas 36 flow rate and temperature, applied voltages and relative APCI probe 378 and ES inlet probe 301 positions to achieve optimal performance in all operating modes.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled

The invention claimed is:

1. An atmospheric pressure ion source, comprising:

a nebulizer configured to nebulize a sample;

a vaporizer configured to vaporize the nebulized sample to provide a vaporized sample;

a corona discharge needle positioned in a path of the vaporized sample, the corona discharge needle comprising a tip surrounded by at least one counter electrode, and a gas sample inlet port;

wherein the ion source is configured so that during operation the ion source generates a corona discharge region at the tip which generates ions from the vaporized sample and the counter electrode at least partially shields the corona discharge region.

2. The ion source of claim 1, wherein the gas sample inlet port is connected to a gas chromatograph.

3. The ion source of claim 2, further comprising a heated inlet through which samples from the gas chromatograph are configured to be introduced into the ion source.

4. The ion source of claim 1, further comprising a vapor flow channel, the vapor flow channel being arranged to direct the vaporized sample to the corona discharge region.

5. The ion source of claim 4, wherein during operation an electric field penetrating into said vapor flow channel directs generated ions away from walls of the vapor flow channel.

6. The ion source of claim 1, wherein the vaporizer is a heater.

7. The ion source of claim 1, wherein the counter electrode surrounds a tip of the corona discharge needle.

8. The ion source of claim 1, further comprising one or more inlet assemblies for delivering the sample to the nebulizer.

9. The ion source of claim 1, wherein the ion source is adapted to deliver ions to a mass to charge analyzer.

10. The ion source of claim 1, wherein the ion source comprises an Atmospheric Pressure Chemical Ionization probe.

11. The ion source of claim 10, further comprising an auxiliary gas inlet into said Atmospheric Pressure Chemical Ionization probe.

12. A mass spectrometry system, comprising:

the ion source of claim 1; and a mass to charge analyzer positioned to receive ions from the ion source.

13. The system of claim 12, wherein the mass to charge analyzer comprises a time-of-flight mass to charge analyzer.

* * * * *